US005387252A

United States Patent [19]

Nagao

[11] Patent Number: 5,387,252

[45] Date of Patent: Feb. 7, 1995

[54] CRYOGENIC REFRIGERATOR

[75] Inventor: Masashi Nagao, Amagasaki, Japan

[73] Assignee: Mitsubishi Denki Kabushiki Kaisha, Tokyo, Japan

[21] Appl. No.: 39,816

[22] Filed: Mar. 30, 1993

[30] Foreign Application Priority Data

Mar. 31, 1992 [JP] Japan ..... 4-076864
Mar. 17, 1993 [JP] Japan ..... 5-056817

[51] Int. Cl.[6] ..... F25B 9/00
[52] U.S. Cl. ..... 62/6; 62/196.2
[58] Field of Search ..... 62/6, 196.2, 228.5, 62/47.1

[56] References Cited

U.S. PATENT DOCUMENTS 4,766,741 8/1988 Bartlett et al. ..... 62/47.1 X
4,790,147 12/1988 Kuriyama et al. ..... 62/47.1 X
4,796,443 1/1989 Bartlett ..... 62/47.1
5,092,130 3/1992 Nagao et al. ..... 62/6
5,144,805 9/1992 Nagao et al. ..... 62/6
5,144,810 9/1992 Nagao et al. ..... 62/471
5,154,063 10/1992 Nagao et al. ..... 62/55.5

OTHER PUBLICATIONS

Cryogenic Engineering Handbook, Sep. 15, 1982, p. 140.

45th Meeting on Cryogenics and Superconductivity, May 14–16, 1991, p. 197; "Effects of Cross-sectional Area of the Second-Stage Expansion Space of Two-Stage GM Refrigerator on Refrigeration Capacity".

*Primary Examiner*—William E. Tapolcai
*Attorney, Agent, or Firm*—Oblon, Spivak, McClelland, Maier & Neustadt

[57] ABSTRACT

A cryogenic refrigerator which is capable of preventing a deterioration in refrigerating performance and which has high efficiency includes: a first compressor; a first expander having at least one accumulator using an accumulating material comprising of a rare earth alloy or compound which has a large specific weight at 10 K. or below or an accumulating material comprising of helium; a sub-expansion space which effects further expansion of a working fluid introduced thereto from an expansion space of the first expander; and a second compressor which compresses the working fluid returning from the sub-expansion space.

4 Claims, 26 Drawing Sheets

CRYOGENIC REFRIGERATOR

BACKGROUND OF THE INVENTION

1. Field of the Invention

This invention relates to a cryogenic refrigerator.

2. Description of the Related Art

FIG. 25 shows the construction of a conventional cryogenic refrigerator as disclosed, for example, in the summary of the lectures presented at the 45th Spring Meeting of the Cryogenic Superconduction Society. The cryogenic refrigerator shown is a Gifford-MacMahon-cycle refrigerator. In the drawing, numeral 1 indicates helium, which serves as the working fluid; numeral 2 indicates an inlet valve for charging in the helium 1; and numeral 3 indicates an outlet valve for discharging the helium 1. Numeral 4 indicates a first-stage expansion space; numeral 5 indicates a first-stage displacer which moves the helium 1 through a reciprocating movement; and numeral 6 indicates a first-stage accumulator, which contains a first-stage accumulating material which consists, for example, of disc-shaped phosphor bronze gauzes that are stacked together and tiny lead balls. Numeral 7 indicates a first-stage seal, which prevents the helium 1 in the first-stage expansion space 4 from flowing through the periphery of the first-stage displacer 5. Numeral 8 indicates a first refrigerating stage which absorbs thermal energy from an object to be cooled (not shown); and numeral 9 indicates a first-stage cylinder.

Numeral 10 indicates a second-stage expansion chamber; numeral 11 indicates a second-stage displacer which moves the helium 1 through a reciprocating movement; and numeral 12 indicates a second-stage accumulator containing a second-stage accumulating material which consists, for example, of a particulate matter such as Ho1.5Er1.5Ru, Er3Ni, or GdRh. Numeral 13 indicates a second-stage seal, which prevents the helium 1 in the second-stage expansion chamber 10 from flowing through the periphery of the second-stage displacer 11. Numeral 14 indicates a second refrigerating stage, which absorbs thermal energy from the object to be cooled (not shown); and numeral 15 indicates a second-stage cylinder.

Numeral 16 indicates a motor for driving the displacers 5 and 11; numeral 17 indicates a drive shaft for transmitting the driving force of the motor 16; and numeral 18 indicates a crank for converting rotary motion to linear motion. Numeral 19 indicates a compressor for compressing the helium 1; numeral 20 indicates a high-pressure buffer tank for mitigating fluctuations in pressure at a higher pressure level; numeral 21 indicates a low-pressure buffer tank for mitigating fluctuations in pressure at a lower pressure level; and numeral 22 indicates a differential pressure retaining device for keeping constant a differential pressure between the higher and lower pressure levels. Numeral 23 indicates thermal energy Qa absorbed by the first refrigerating stage 8; and numeral 24 indicates thermal energy Qb absorbed by the second refrigerating stage 14.

Next, the operation of this apparatus will be described. FIG. 26 is a graph showing the P-V chart of this refrigerator. The vertical axis indicates the pressure P of the second-stage expansion chamber 10, and the horizontal axis indicates the volume V of the same. In the condition indicated at D in FIG. 26, the second-stage displacer 11 is at its lowest position, and since the inlet valve 2 is closed and the outlet valve 3 is open, the pressure in the second-stage expansion space 10 is at a low level (e.g., approximately 6 bar). During the process of D-A, the outlet valve 3 is closed and the inlet valve 2 is opened, so that the pressure is raised to a higher level (e.g., approximately 20 bar).

Next, during the process of A-B, the displacers 5 and 11 are moved upwards and, at the same time, the helium 1 at the higher pressure level is introduced from the compressor 19 to the expansion spaces 4 and 10 while being cooled as it passes through the accumulators 6 and 12. Through stationary operation a temperature gradient is developed in accumulators 6 and 12 respectively. For example, the temperature at the upper end of the first-stage accumulator 6 is 300 K., whereas that at the lower end thereof is 30 K.; and the temperature at the upper end of the second-stage accumulator 12 is 30 K., whereas that at the lower end thereof is approximately 4 K. Accordingly, the helium 1 introduced into the first-stage expansion space 4 is cooled to approximately 30 K., and that introduced into the second-stage expansion space 10 is cooled to approximately 4 K. (The accumulating material used in the second-stage accumulator 12 is a rare earth alloy or compound which exhibits large specific heat at 10 K. or less, such as Hol.5Erl.-5Ru, Er3Ni, or GdRh, which accumulating material, however, is very expensive, costing as much as 2,000 to 10,000 yen per gram. In spite of this high price, such a material is used because other accumulating materials such as lead or copper have rather small specific heat at a low temperature of approximately 10 K. or less, so that heat exchange cannot be carried out in the accumulators, and the temperature of 4 K. is not reached.) Since any high-temperature helium 1 allowed to flow into the second-stage seal 13 will constitute a heat load, the second-stage seal 13 is precisely made so as to minimize leakage. Also, since the accumulators 6 and 12 are heated by the helium 1, they exhibit a temperature distribution higher than the initial one.

During the process of B-C, the inlet valve 2 is closed and the outlet valve 3 is opened. In this process, the helium 1 in the expansion space 4 and 10 is expanded to change from the high-pressure state to the low-pressure state. In the course of this expansion process, the helium 1 in the expansion space 4 absorbs thermal energy Qa 23 from the object to be cooled (not shown) through the first refrigerating stage 8. Similarly, the helium 1 in the expansion chamber 10 absorbs thermal energy Qb from the object to be cooled (not shown) through the second refrigerating stage 14. When the temperature at this time is such that because of the change of helium 1 can be regarded as ideal gas when used in an isothermal process, the thermal energy that can be absorbed is equal to the area of the P-V chart. If the temperature is as low as approximately 4 K., the thermal property valves of the helium 1, the amount of thermal energy that can be absorbed is reduced to a level approximately 10 % of the area of the P-V chart.

The helium 1 then cools the accumulators 6 and 12, and returns to the compressor 19. In the condition indicated at C in FIG. 26, the pressure level in the expansion spaces 4 and 10 has become low.

In the process of C-D, the displacers 5 and 11 move downwardly to discharge the helium 1 whose pressure level has been lowered. After cooling the accumulator 6 and 12, the helium 1 returns to the compressor 19. If, in this process, the helium 1 at the low temperature is allowed to leak through the secon-stage seal 13, part of the helium 1 will flow away and not cool the accumulator 12, resulting in a heat loss. This is another reason why it is necessary to precisely work out the second-stage seal 13. In the process of B-D, the accumulators 6 and 12 are cooled to restore their temperature distribution at the cycle start.

In the conventional cryogenic refrigerator, constructed as described above, the thermal energy Qb that can be absorbed is reduced due to the thermal properties of helium, resulting in a deterioration in refrigeration efficiency. Further, the rare earth alloy or compound used is very expensive, resulting in an increase in the cost of the refrigerator. In addition, the seals 7 and 13 of the displacer sections become worn after a long term operation, with the result that leakage allowing the helium 1 to flow into the expansion spaces 4 and 10 occurs, resulting in refrigerating efficiency and reliability deteriorating.

SUMMARY OF THE INVENTION

This invention has been made with a view toward solving the above problems. It is an object of this invention to provide a cryogenic refrigerator which prevents a deterioration in refrigeration performance and which provides highly efficient and reliable refrigerating at low cost.

In order to achieve the above object, according to a first aspect of the present invention, there is provided a cryogenic refrigerator comprising: a first compressor; a first expander having at least one accumulator using an accumulating material comprising a rare earth alloy or compound which has a large specific heat at 10 K. or below or an accumulating material comprising helium; a second expander which effects further expansion of a working fluid introduced thereto from an expansion space of the first expander; and a second compressor which compresses the working fluid.

According to a second aspect of the present invention, the second expander of the cryogenic refrigerator includes a displacement-type expander body, an inlet valve, an outlet valve, and a power absorption mechanism.

According to a third aspect of the present invention, the second expander of the cryogenic refrigerator includes a Simon-expansion-type expander body, an inlet valve, an outlet valve.

According to a fourth aspect of the present invention, the second expander of the cryogenic refrigerator comprises a throttle section.

According to a fifth aspect of the present invention, a control valve is provided on the outlet side of an expansion space of the first expander, and a buffer tank for temporarily storing the working fluid is provided between this control valve and the second expander.

According to a sixth aspect of the present invention, the cryogenic refrigerator has at least one heat exchanger which performs heat exchange between the working fluid returning from the second expander and the working fluid in the first expander.

Further, according to a seventh aspect of the present invention, the cryogenic refrigerator further comprises at least one throttle section capable of generating a controlled leakage, and at least one heat exchange section for effecting heat exchange between the working fluid passing through this throttle section and the working fluid returning from the second expander.

In a cryogenic refrigerator constructed in accordance with the first aspect of the present invention, an increase in refrigerating efficiency due to the physical properties of helium can be realized by expanding the helium 1, which is a working fluid at a low pressure level, to approximately 1 bar by means of the second expander.

In a cryogenic refrigerator constructed in accordance with the second aspect of the present invention, a displacement-type expander is provided as the second expander. By expanding the helium, which is a working fluid at a low pressure level, by means of this second expander, an increase in refrigerating efficiency due to the physical properties of helium can be realized.

In a cryogenic refrigerator constructed in accordance with the third aspect of the present invention, a Simon-expansion-type expander is used as the second expander, so that an increase in refrigerating efficiency can be achieved, power absorption is increased, and a simplified structure can be realized.

In a cryogenic refrigerator constructed in accordance with the fourth aspect of the present invention, an expander using a throttle section is employed as the second expander, so that an increase in refrigerating efficiency is achieved, the overall construction is remarkably simplified, and a reduction in cost can be realized.

With a cryogenic refrigerator constructed in accordance with the fifth aspect of the present invention, a control valve is provided at the outlet of an expansion space of the accumulation-type refrigerator and a helium buffer tank is arranged between this valve and the second expander, whereby the helium, which is a working fluid at a low pressure level, can be selectively expanded. As a result, the refrigeration output by the second expander is stabilized and, at the same time, an increase in refrigerating efficiency can be achieved.

In a cryogenic refrigerator constructed in accordance with the sixth aspect of the present invention, at least one heat exchange section for effecting heat exchange between the helium returning from the second expander and the helium in the state in which it is charged or discharged by the accumulation-type refrigerator, whereby it is possible to omit the accumulating material of at least one section of the accumulation-type refrigerator, thereby achieving a reduction in cost.

In a cryogenic refrigerator constructed in accordance with the seventh aspect of the present invention, there is provided an accumulation-type refrigerator having at least one throttle section capable of generating a controlled leakage, and at least one heat exchange section for effecting heat exchange between the working fluid passing through this throttle section and the working fluid returning from the second expander. Therefore, no seal is required, whereby the problem due to the seal becoming worn can be eliminated, thereby lengthening the service life of the apparatus and improving the refrigerating efficiency thereof.

DESCRIPTION OF THE PREFERRED EMBODIMENTS

First Embodiment

Figure 1:
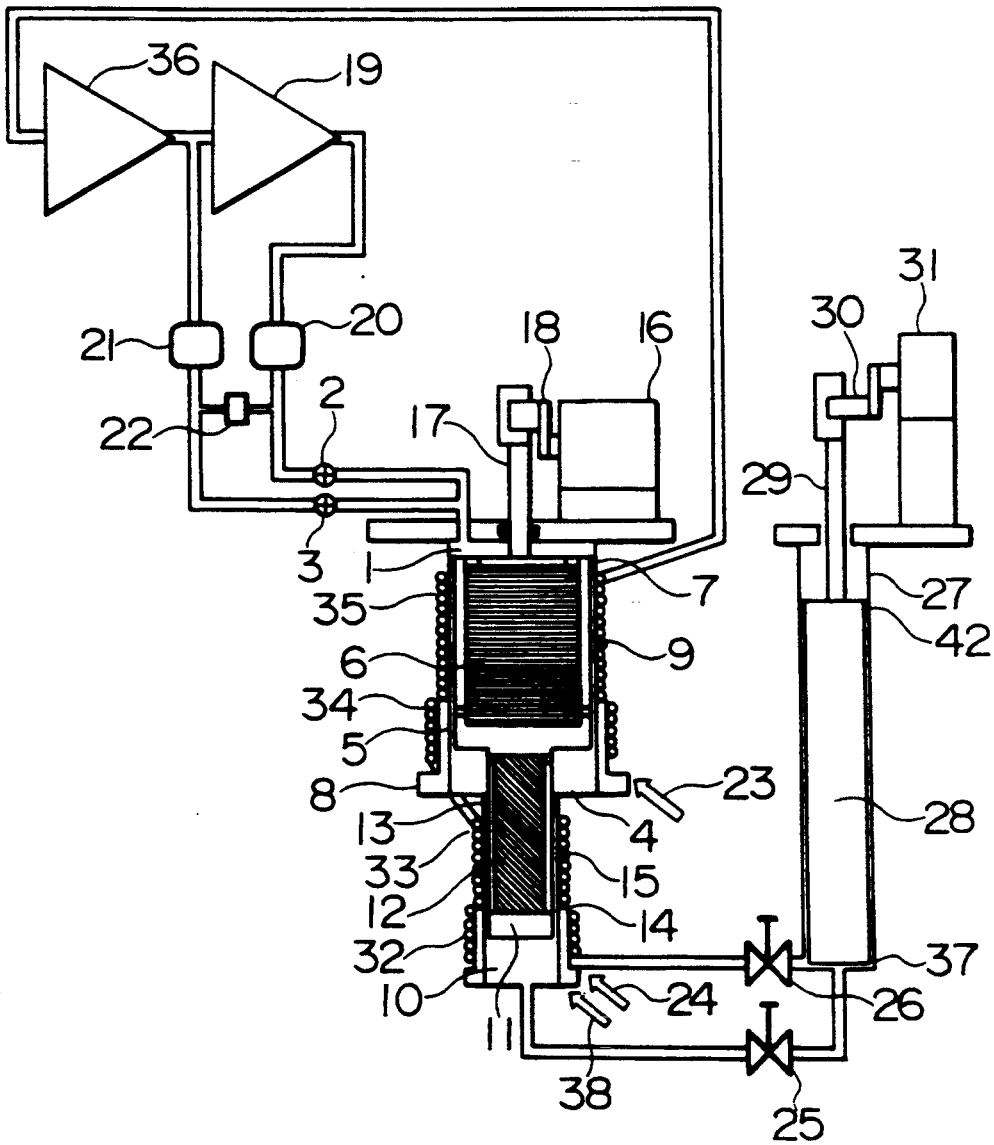
FIG. 1 is a diagram showing the construction of a cryogenic refrigerator according to a first embodiment of this invention.

FIG. 1 shows the construction of a cryogenic refrigerator according to the first embodiment of this invention. In the drawing, the components indicated by numerals 1 through 24 are the same as those of the conventional apparatus and in this embodiment, as in the conventional apparatus, the working fluid 1 consists of helium. In the drawing, numeral 37 indicates a sub-expansion space connected to the second-stage expansion space 10 of an accumulation-type refrigerator having a construction similar to that of the conventional apparatus. Numeral 25 indicates a sub-inlet valve for introducing the helium in the second-stage expansion chamber 10 into the sub-expansion space 37; numeral 26 indicates a sub-outlet valve for discharging the helium in the sub-expansion space 37; numeral 27 indicates a cylinder; numeral 28 indicates a piston; numeral 31 indicates a power absorber; numeral 29 indicates a rod for transmitting the force received by the piston 28 to the power absorber 31; numeral 30 indicates a crank; numeral 32 indicates a first heat exchanger; numeral 33 indicates a second heat exchanger; numeral 34 indicates a third heat exchanger; numeral 35 indicates a fourth heat exchanger; numeral 36 indicates a second compressor, which comprise, for example, a compressor adjusted to a lower pressure level; and numeral 42 indicates a seal for preventing the helium 1 in the subexpansion space 37 from flowing through the periphery of the piston 28.

In this cryogenic refrigerator, constructed as described above, the operations of the first compressor 19, the valves 2 and 3, and the displacers 5 and 11 are the same as those in the conventional apparatus. In addition to these components, the apparatus of this embodiment includes the sub-expansion space 37, which constitutes the displacement-type expander body, the sub-inlet valve 25, and the sub-outlet valve 26. The piston 28, the rod 29, the crank 30 and the power absorber 31 constitute a power absorption mechanism. The sub-expansion space 37, the sub-inlet valve 25, the sub-release valve 26, and the power absorption mechanism constitute a second expander.

Figure 26:
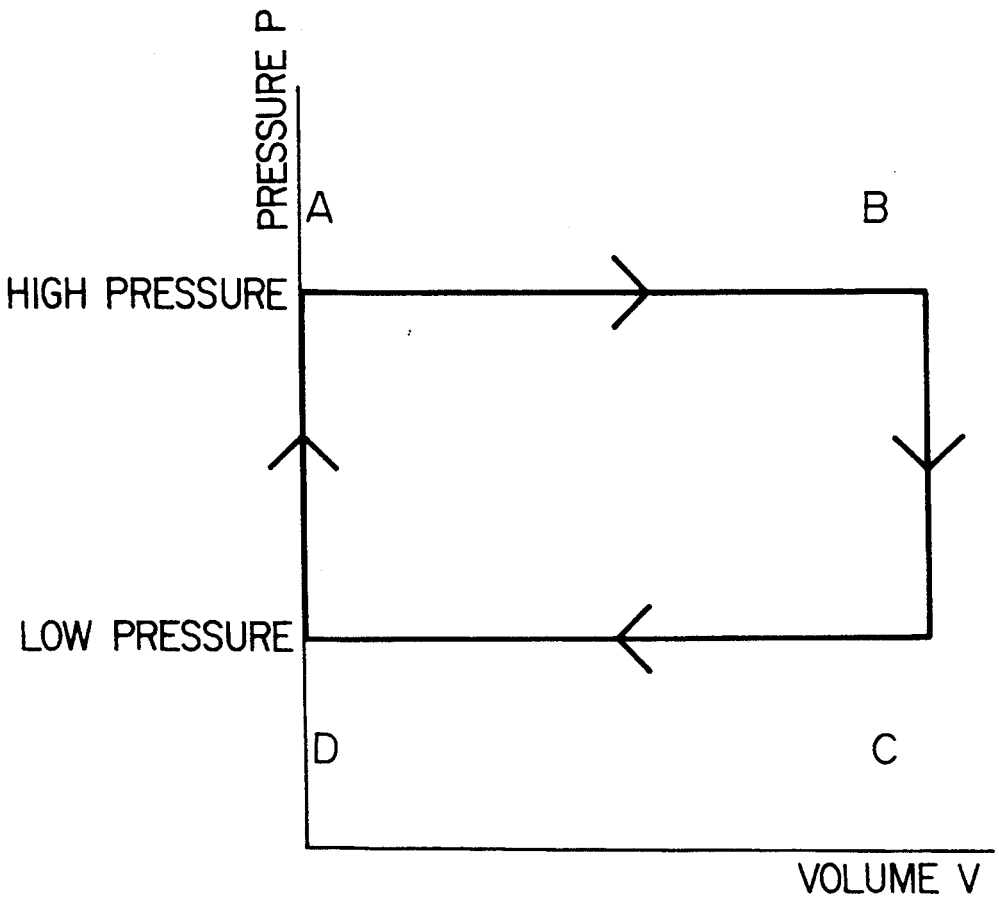
FIG. 26 PRIOR ART
FIG. 26 is a diagram showing the P-V chart of a cryogenic refrigerator.

Next, the operation of this second expander will be described. In the process C-D of the cycle shown in FIG. 26, the sub-inlet valve 25 is opened and the sub-outlet valve 26 is closed to introduce a fixed amount of the helium 1 present in the second-stage expansion chamber 10 into the sub-expansion space 37 through the sub-inlet valve 25. This helium 1 pushes up the piston 28 as the helium expands, for example, from 6 bar to 1 bar, thereby exerting a work on the power absorber 31 through the piston 28, the rod 29 and the crank 30. After this, the sub-inlet valve 25 is closed and the sub-outlet valve 26 is opened, whereby the helium 1 is discharged through the sub-outlet valve 26. As a result, the helium 1 absorbs thermal energy Qc 38 from the object to be cooled (not shown) through the second refrigerating stage 14 and the first heat exchanger 32. The sub-inlet valve 25 and the sub-outlet valve 26 are controlled mechanically by using a cam or the like, or electrically by using a sensor and an electromagnetic valve or the like.

Further, the helium 1 is warmed by the second heat exchanger 33, the third heat exchanger 34 which transmits a refrigeration effect to the first refrigerating stage 8, and the fourth heat exchanger 35, and the helium is returned, in a room temperature condition and at 1 bar, to the suction side of the compressor 36 adjusted to the lower pressure level. After this, the helium 1 is compressed by the compressor 36 adjusted to the lower pressure level and discharged to the first compressor 19 to be further compressed and circulated.

Figure 2:
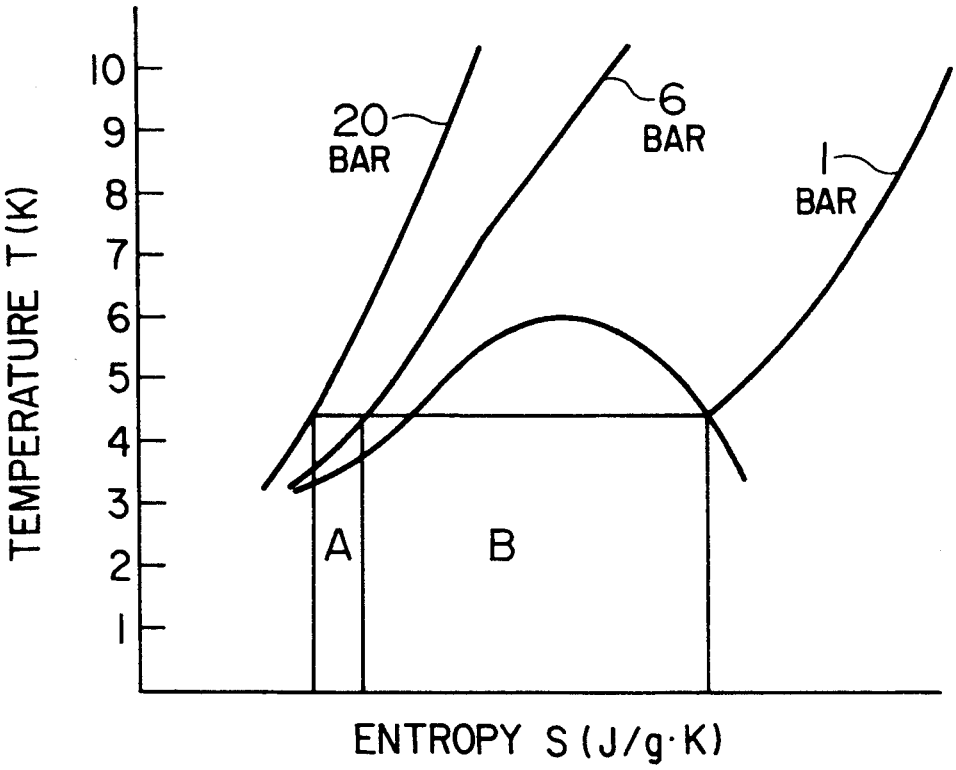
FIG. 2 is a graph showing a helium TS chart.

FIG. 2 is a graph showing the TS chart of the helium 1. The vertical axis indicates temperature T (K.) and the horizontal axis indicates entropy S (J/g.K). As shown in the drawing, in the range from 20 bar to 6 bar, it is only possible to obtain a thermal energy absorption amount corresponding to the area indicated by A even if a highly efficient isothermal expansion is effected. In contrast, in the range from 6 bar to 1 bar, a thermal energy absorption amount corresponding to the area indicated by B can be obtained, so that a high level of refrigerating efficiency can be achieved. Thus, it will be appreciated that, by providing, as in this first embodiment, the displacement-type sub-expansion space 37, the sub-inlet valve 25 and the sub-outlet valve 26 as the second expander, a high level of refrigerating efficiency can be achieved due to the physical properties of the helium 1. Further, since the helium is expanded after being cooled to approximately 4 K., a complicated heat exchanger is not needed, and the a cryogenic refrigerator having a more simpler structure and higher reliability than the conventional cryogenic refrigerator consisting of a GM refrigerator thermally connected to a JT circuit can be obtained.

Second Embodiment

Figure 3:
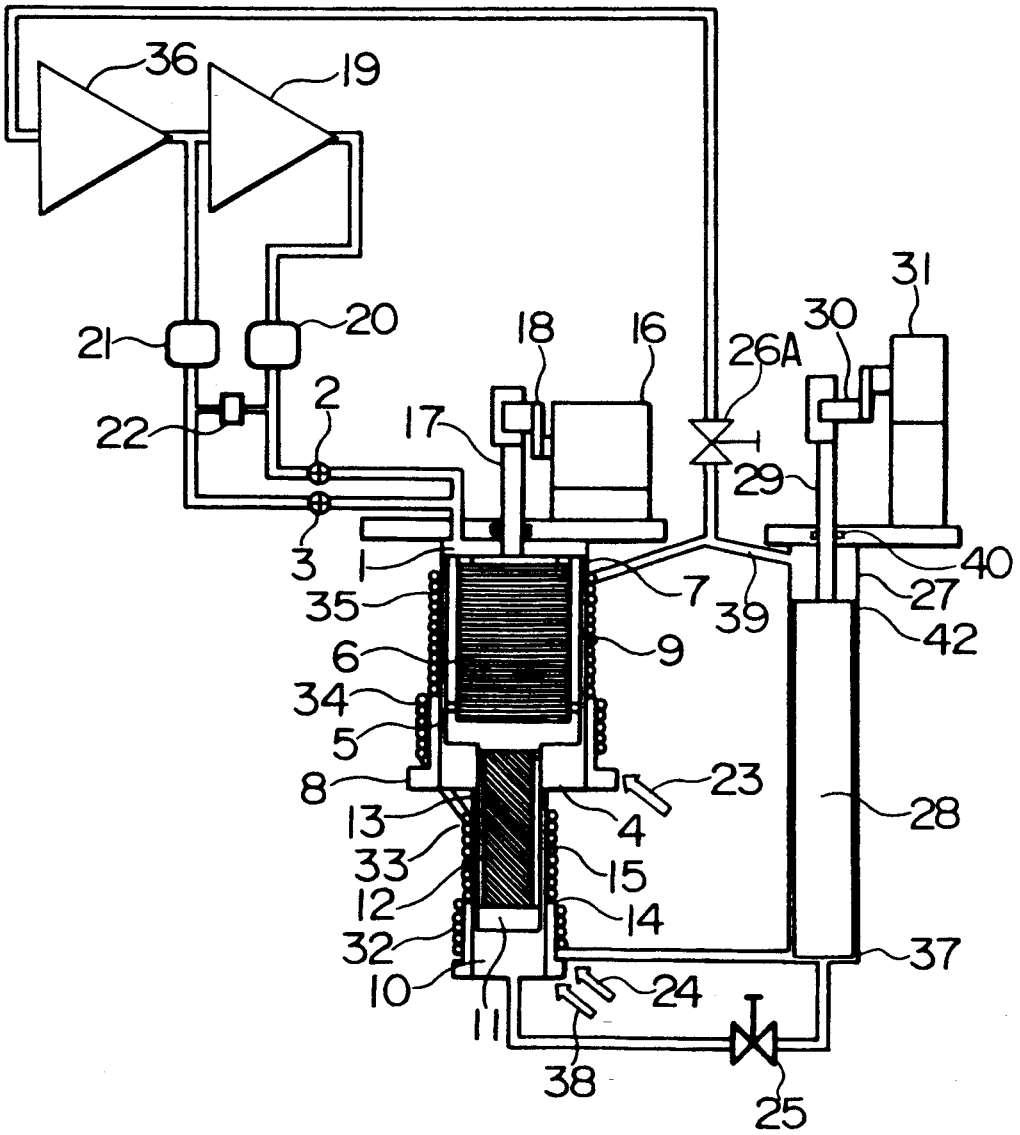
FIG. 3 is a diagram showing the construction of a cryogenic refrigerator according to a second embodiment of this invention.

FIG. 3 shows the construction of a cryogenic refrigerator according to the second embodiment of this invention. In the drawing, the components which are the same as or equivalent to those of the first embodiment are indicated by the same reference numerals. Numeral 26A indicates a sub-outlet valve which is in a room-temperature section and which is used to discharge the helium 1 present in the second-stage expansion space 10 that has been introduced through the sub-inlet valve 25. Numeral 27 indicates a cylinder; numeral 28 indicates a displacer; numeral 29 indicates a rod for driving the displacer 28; numeral 30 indicates a crank; and numeral 31 indicates a driving motor. Numeral 39 indicates a communicating tube which serves to equalize the pressure of the room-temperature section and the low-temperature section so that substantially no force due to a pressure difference is applied to the displacer 28. Numeral 40 indicates a seal.

In this cryogenic refrigerator, constructed as described above, the sub-expansion space 37 which is a Simon-expansion-type expander body, the sub-inlet valve 25 and the sub-outlet value 26A are provided. The refrigerator is adjusted beforehand, for example, in such a way that in the state indicated at D in the cycle shown in FIG. 26, the capacity of the sub-expansion space 37 is substantially the maximum one; and in the cycle process C-D, the sub-inlet valve 25 is opened to introduce the helium 1 present in the second-stage expansion space 10 into the sub-expansion space 37. After this, the sub-inlet valve 25 is closed and the sub-release valve 26A is opened, whereby the helium 1 undergoes Simon expansion to a level, for example, of 1 bar. As a result, the helium 1 absorbs thermal energy Qc 38 from the object to be cooled (not shown) through the second refrigerating stage 14 and the first heat exchanger 32.

After this, the helium 1 is warmed by the second heat exchanger 33, the third heat exchanger 34 which transmits a refrigeration effect to the first refrigerating stage 8, and the fourth heat exchanger 35, and the helium is returned, in a room-temperature condition, to the suction side of the compressor 36 adjusted to the lower pressure level.

In this second embodiment, the communicating tube 39 is provided so that it is possible to achieve an improvement in refrigerating efficiency. Further, unlike the first embodiment, which employes a piston, this embodiment can prevent a large force from being applied to the displacer 28, and enable the structure of the cryogenic refrigerator to be simplified.

Third Embodiment

Figure 4:
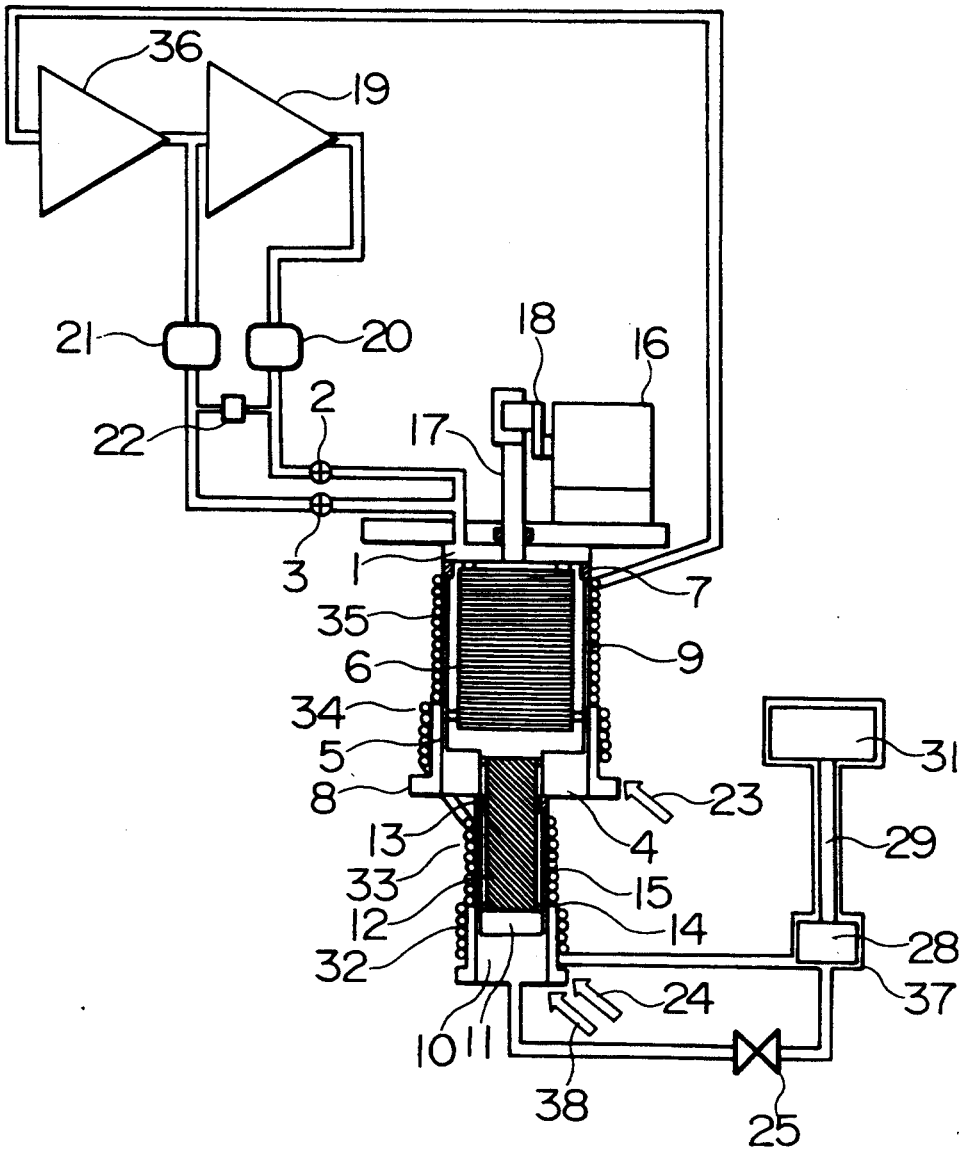
FIG. 4 is a diagram showing the construction of a cryogenic refrigerator according to a third embodiment of this invention.

FIG. 4 shows the construction of a cryogenic refrigerator according to the third embodiment of this invention. In the drawing, the components which are the same as or equivalent to those of the first embodiment are indicated by the same reference numerals. Numeral 25 indicates a throttle section connected to the second expansion space 10, which throttle section consists, for example, of a stationary-type throttle valve for flow rate adjustment; numeral 28 indicates an expansion turbine; and numeral 29 indicates a rod for transmitting the work of the expansion turbine 28 to the power absorber 31.

This cryogenic refrigerator, constructed as described above, includes, as the second expander, the expansion turbine 28, of which the body of a turbine-type expander is constituted, and the stationary-type throttle valve 25, the helium 1 present in the second-stage expansion chamber 10 being introduced into the expansion turbine 28 through the stationary-type throttle valve 25.

Since the throttle valve 25 is of a stationary type, the helium 1 is constantly supplied to the expansion turbine 28. The helium 1 is expanded in the expansion turbine 28, and transmits the expansion work to the power absorber 31 through the rod 29 so as to effect power absorption. After this, the helium 1 absorbs thermal energy Qc 38 from the object to be cooled (not shown) through the second refrigerating stage 14 and the first heat exchanger 32. Further, the helium 1 is warmed by the second heat exchanger 33, the third heat exchanger 34 which transmits a refrigeration effect to the first refrigerating stage 8, and the fourth heat exchanger 35, and the helium 1 is returned, in a room-temperature condition, to the suction side of the compressor 36 adjusted to the lower pressure level.

With the construction of this third embodiment, it is possible to enhance the refrigerating efficiency, simplify the structure and improve the reliability of the cryogenic refrigerator.

Fourth Embodiment

Figure 5:
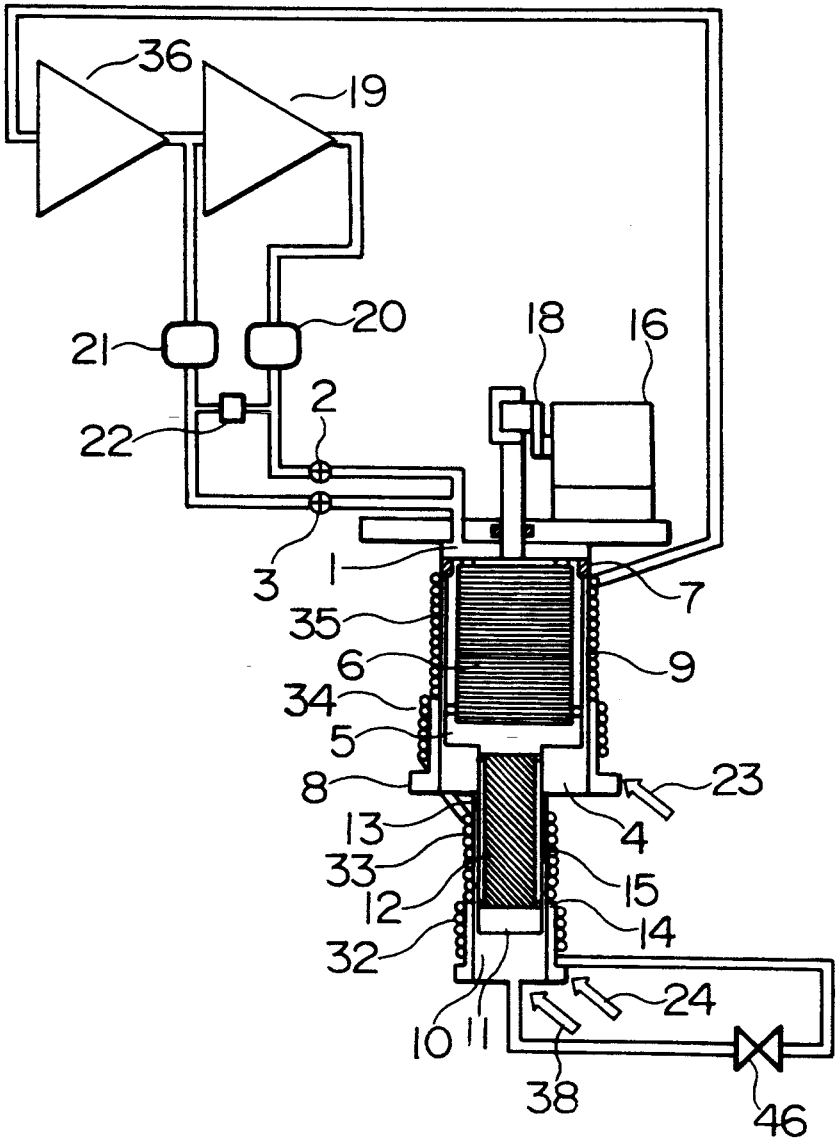
FIG. 5 is a diagram showing the construction of a cryogenic refrigerator according to a fourth embodiment of this invention.

FIG. 5. shows the construction of a cryogenic refrigerator according to the fourth embodiment of this invention. In the drawing, the components which are the same as or equivalent to those of the first embodiment are indicated by the same reference numerals. Numeral 46 indicates a throttle section for effecting Joule-Thomson expansion (hereinafter referred to as "JT expansion"), which can be realized in the form of a throttle valve, capillary, porous member, or the like. In the example shown, a throttle valve is employed.

In this cryogenic refrigerator, constructed as described above, a throttle valve 46 is used as the second expander. The throttle valve 46, which is of a stationary type, constantly supplies part of the helium 1 present in the second-stage expansion chamber 10, and JT expansion is effected by the throttle valve 46. As a result, it is possible for the helium 1 to absorb thermal energy Qc 38 from the object to be cooled (not shown) through the second refrigerating stage 14 and the first heat exchanger 32. After this, the helium 1 is warmed by the second heat exchanger 33, the third heat exchanger 34 which transmits a refrigeration effect to the first refrigerating stage 8, and the fourth heat exchanger 35, and the helium 1 is returned, in a room-temperature state, to the suction side of the compressor 36 adjusted to the lower pressure level.

This construction makes it possible to achieve an improvement in refrigerating efficiency, realize a much simpler structure, and attain a reduction in cost.

Fifth Embodiment

Figure 6:
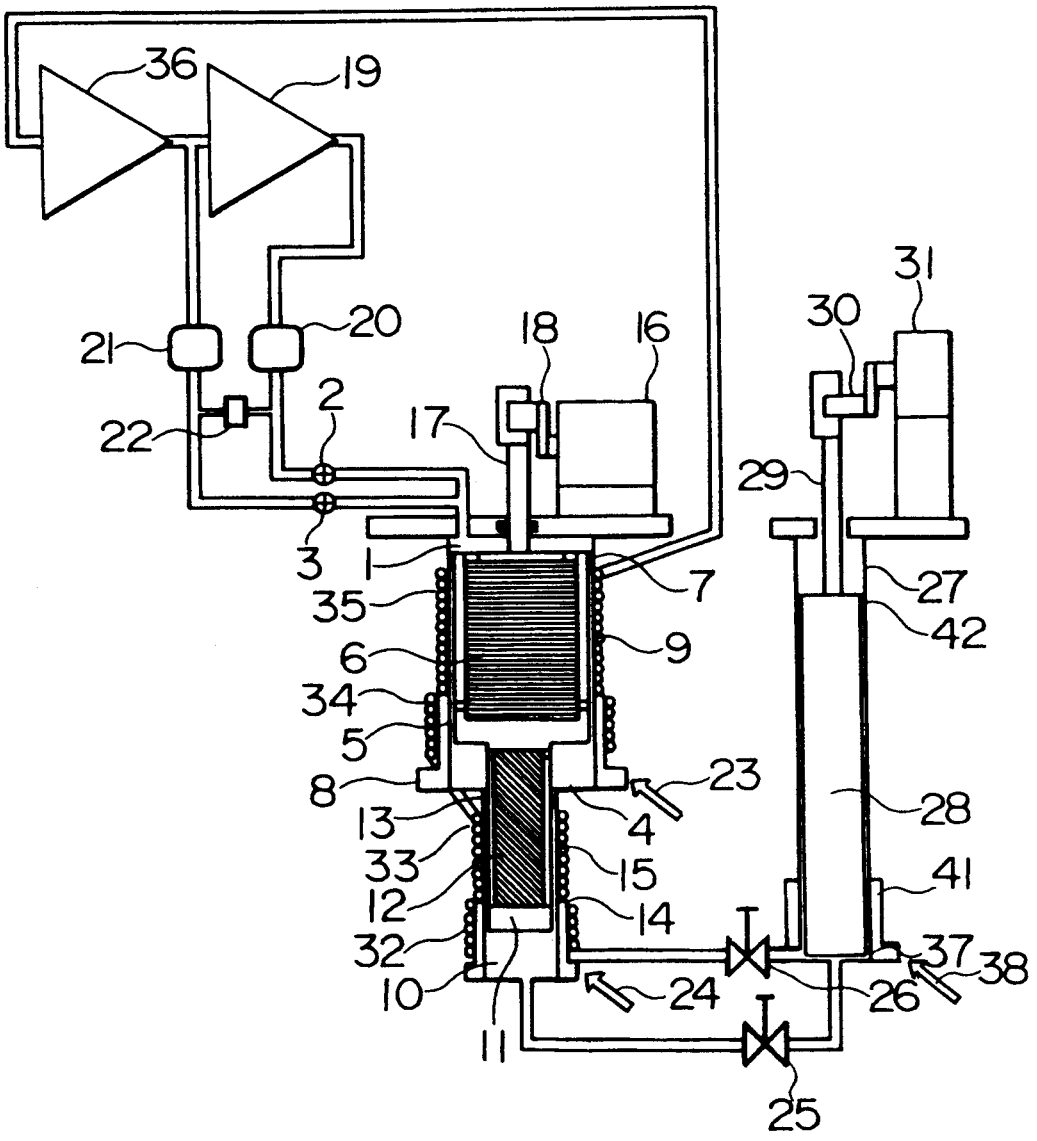
FIG. 6 is a diagram showing the construction of a cryogenic refrigerator according to a fifth embodiment of this invention.

FIG. 6 shows the construction of a cryogenic refrigerator according to the fifth embodiment of this invention. In the drawing, the components which are the same as or equivalent to those of the first embodiment are indicated by the same reference numerals. Numeral 41 indicates a stage provided around the sub-expansion space 37.

The operation of the second expander is the same as that of the first embodiment. That is, in the process C-D of the cycle shown in FIG. 26, the sub-inlet valve 25 is opened and the sub-outlet valve 26 is closed to introduce a fixed amount of the helium 1 present in the second-stage expansion space 10 into the sub-expansion space 37 through the sub-inlet valve 25. This helium 1 pushes up the piston 28 as it expands, for example, from 6 bar to 1 bar, exerting a work on the power absorber 31 through the piston 28, the rod 29 and crank 30. At the same time, it absorbs thermal energy Qc 38 from the object to be cooled (not shown) to thereby effect refrigeration. After this, the sub-inlet valve 25 is closed and the sub-release valve 26 is opened. As a result, the helium 1 is discharged through the sub-outlet valve 26 and warmed by the first heat exchanger 32 which transmits a refrigeration effect to the second refrigerating stage 14, the second heat exchanger 33, the third heat exchanger 34 which transmits a refrigeration effect to the first refrigerating stage 8, and the fourth heat exchanger 35, an the helium 1 returns, in a room-temperature condition and at 1 bar, to the suction side of the compressor 36 adjusted to the lower pressure level.

While in the first embodiment thermal energy Qc 38 is absorbed from the object to be cooled (not shown) through the second refrigerating stage 14 and the first heat exchanger 32, it is also possible, as in this embodiment, to effect refrigeration by causing heat energy Qc 38 to be absorbed from the object to be cooled (not shown) through the stage 41.

Sixth Embodiment

Figure 7:
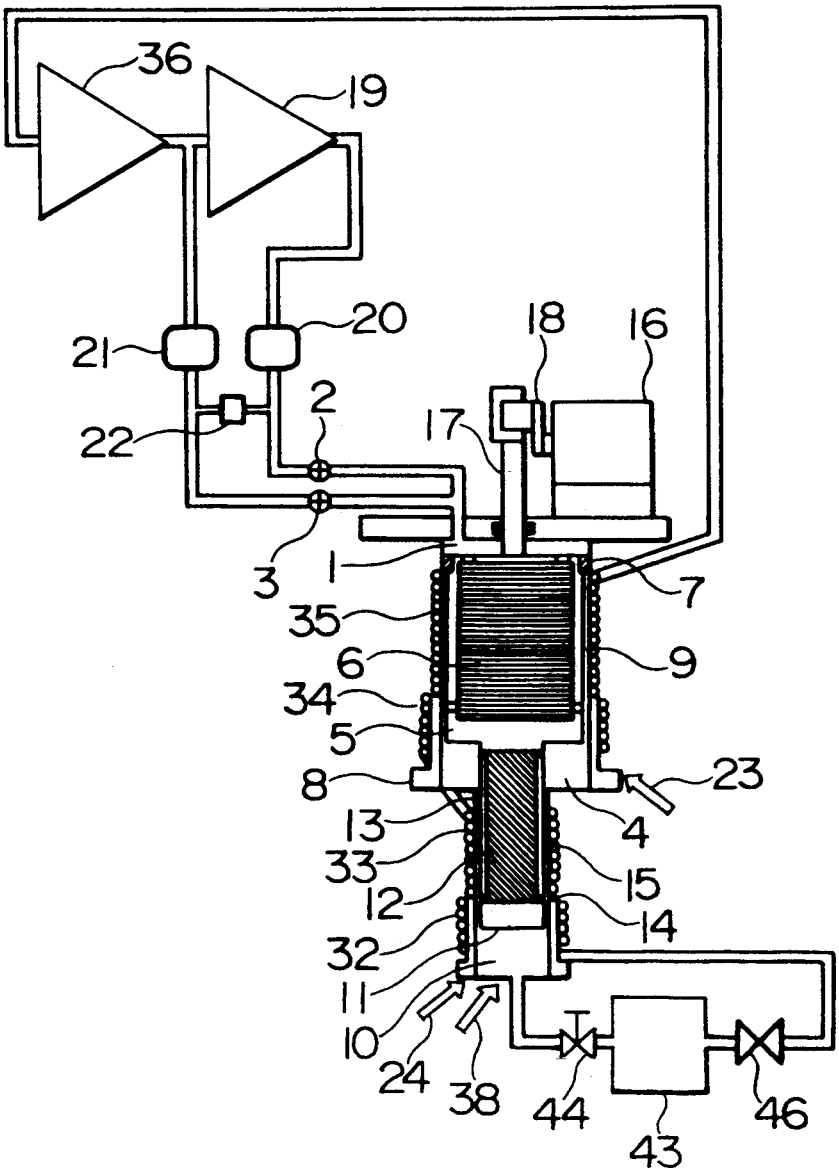
FIG. 7 is a diagram showing the construction of a cryogenic refrigerator according to a sixth embodiment of this invention.

FIG. 7 shows the construction of a cryogenic refrigerator according to the sixth embodiment of this invention. In the drawing, the components which are the same as or equivalent to those of the fourth embodiment are indicated by the same reference numerals. Numeral 44 indicates a control valve connected to the second-stage expansion space 10, and numeral 43 indicates a buffer tank provided between the control valve 44 and the throttle valve 46.

This cryogenic refrigerator, constructed as described above, employs the throttle valve 46 as the second expander.

When the pressure of the helium 1 is at the lower operating pressure (for example, 6 bar), the control valve 44 is opened to selectively transfer the helium 1 present in the second-stage expansion space 10 and store it temporarily in the buffer tank 43. After this, the helium 1 from the buffer tank 43 is caused to undergo JT expansion by the throttle valve 46. As a result, the helium 1 can absorb thermal energy Qc 38 from the object to be cooled (not shown) through the second refrigerating stage 14 and the first heat exchanger 32. The control valve 44 is controlled mechanically by using a cam or the like, or electrically by using a sensor and an electromagnetic valve or the like.

After this, the helium 1 is warmed by the second heat exchanger 33, the third heat exchanger 43 which transmits a refrigeration effect to the first refrigerating stage 8, and the fourth heat exchanger 35, and the helium 1 is returned, in a room-temperature condition, to the suction side of the compressor 36 adjusted to the lower pressure level.

With this construction, the helium 1 at a low pressure level can be selectively expanded, so that a further improvement in refrigerating efficiency can be achieved. At the same time, a much simpler structure is realized and an improvement in reliability is attained. Further, the refrigeration output can be stabilized.

Seventh Embodiment

Figure 8:
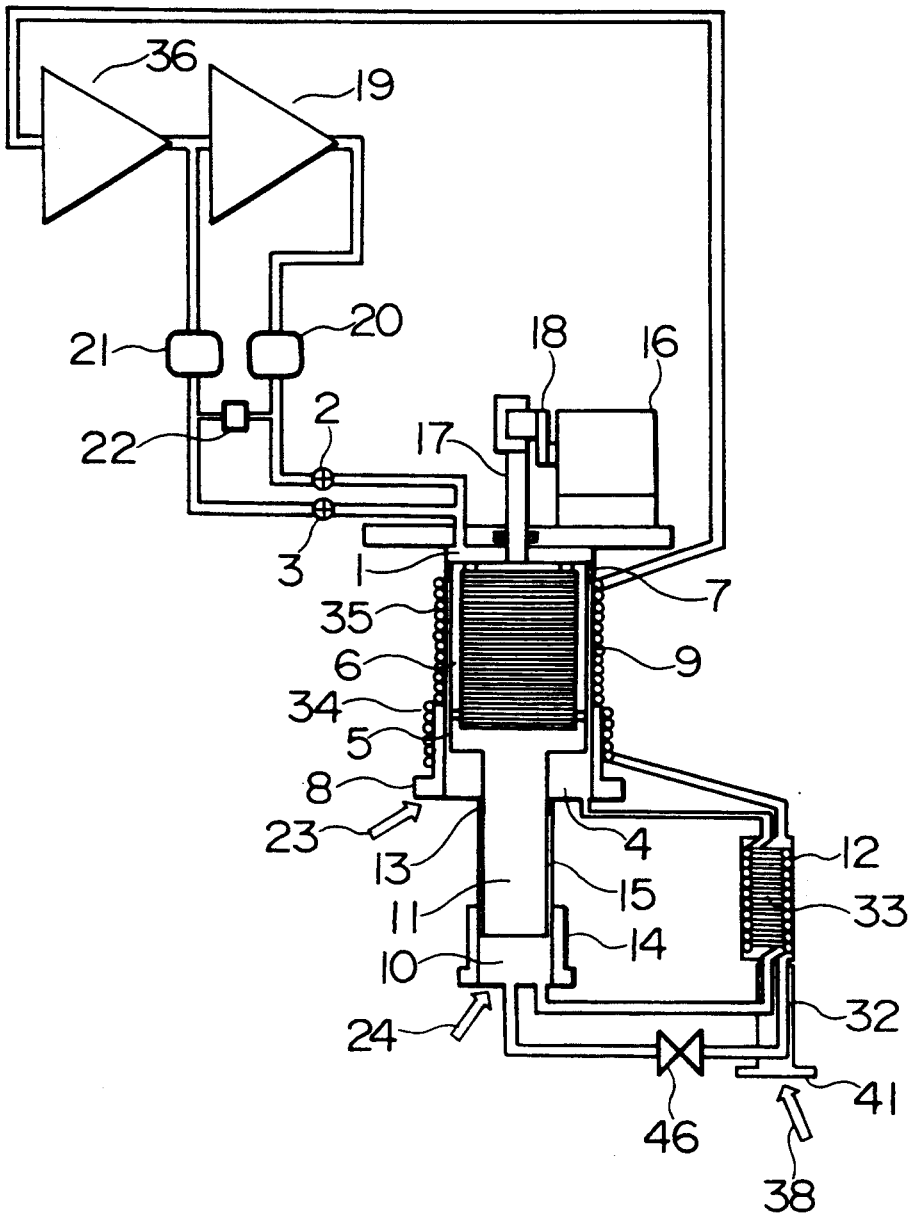
FIG. 8 is a diagram showing the construction of a cryogenic refrigerator according to a seventh embodiment of this invention.

FIG. 8 shows the construction of a cryogenic refrigerator according to the seventh embodiment of this invention. In the drawing, numeral 12 indicates a flow passage adjusted to the higher pressure level of the heat exchange section, and numeral 33 indicates a flow passage adjusted to the lower pressure level of the heat exchange section. The flow passage 33 at the lower pressure level consists, for example, of a mesh fin of copper, aluminum or the like having an extended thermal conduction section. The flow passage 12 at the higher pressure level is wound spirally around the flow passage 33 adjusted to the lower pressure level, with heat exchange being possible between the flow passage 12 at the higher pressure level and the flow passage 33 at the lower pressure level. This heat exchange section serves as the second-stage accumulator. Numeral 32 indicates a first heat exchanger, and numeral 41 indicates a stage. The other components which are the same as or equivalent to those of the fourth embodiment are indicated by the same reference numerals.

This cryogenic refrigerator, constructed as described above, employs a throttle valve 46 as the second expander. As in the case of the apparatus of the fourth embodiment, part of the helium 1 present in the second-stage expansion space 10 is caused to undergo JT expansion by the throttle valve 46. As a result, the helium 1 can absorb thermal energy Qc 38 from the object to be cooled (not shown) through the stage 41 and the first heat exchanger 32. After this, the helium 1 is warmed by the flow passage 33 at the lower pressure level of the heat exchange section, the third heat exchanger 34 which transmits a refrigeration effect to the first refrigerating stage 8, and the fourth heat exchanger 35, and the helium 1 is returned, in a room-temperature condition, to the suction side of the compressor 36 adjusted to the lower pressure level. The helium 1 which is charged in or discharged from the second-stage expansion space passes through the flow passage 12 adjusted to the higher pressure level of the heat exchange section. In this process, it effects heat exchange with the helium 1 present in the flow passage 33 adjusted to the lower pressure level. At this time, the helium 1 at the low pressure level has a large specific heat and operates as a good accumulating material.

A problem with the use of helium as an accumulating material is that the heat conductivity of helium is small, so that a satisfactory heat exchange is difficult to perform. In this embodiment, however, the helium 1 present in the flow passage 33 adjusted to the lower pressure level is flowing, so that a satisfactory heat exchange can be effected, utilizing its specific heat effectively. Further, with this construction, no expensive accumulating material is used, thereby making it possible to realize a reduction in cost. In addition, the refrigerating efficiency of the refrigerator can be enhanced, the structure thereof remarkably simplified, and an improvement in reliability is is achieved.

Figure 9:
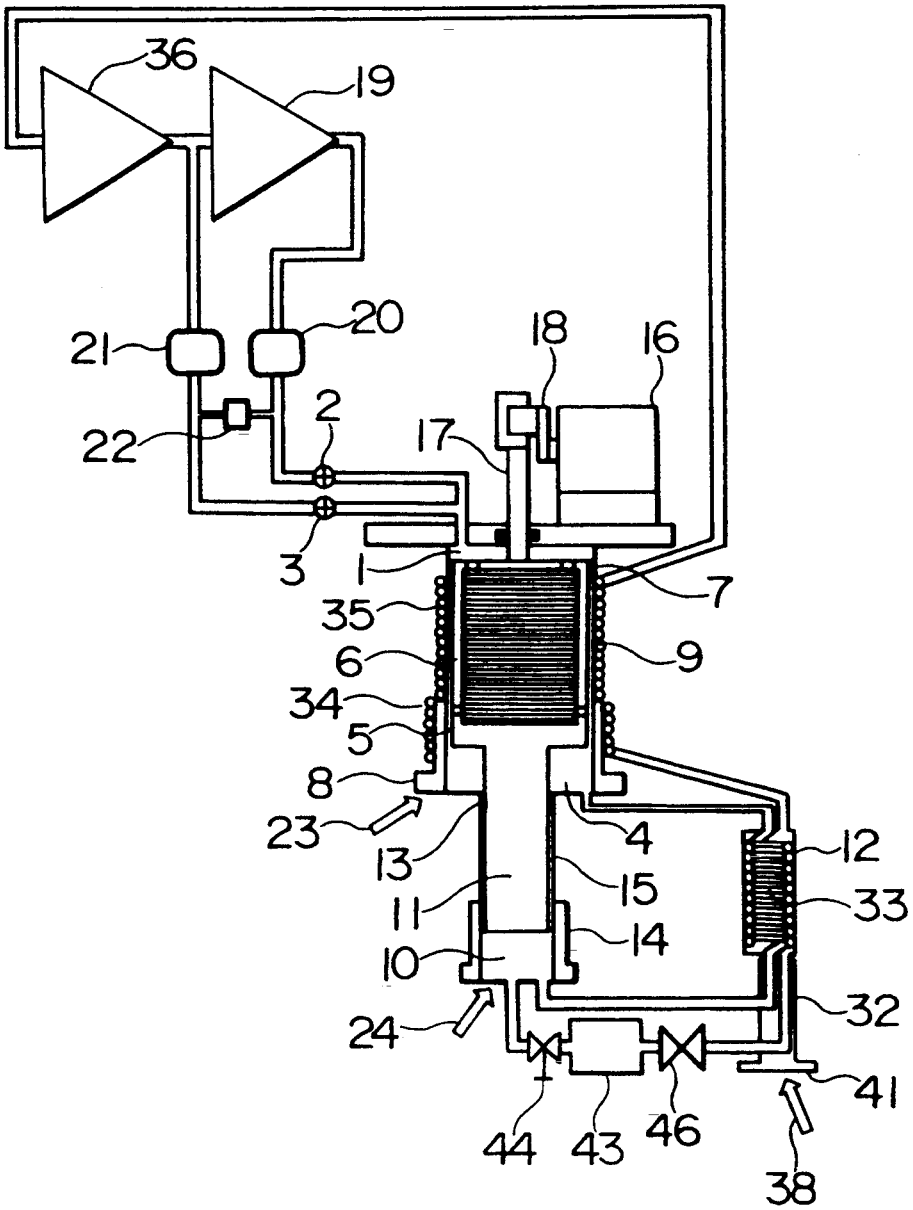
FIG. 9 is a diagram showing the construction of a cryogenic refrigerator according to a modification of the seventh embodiment of this invention.

FIG. 9 shows a modification of the cryogenic refrigerator of this embodiment in which the buffer tank 43 and the control valve 44 of the sixth embodiment are provided. This construction provides, in addition to the effects of the above embodiment, an advantage that, as in the sixth embodiment, the helium 1 at a low pressure level can be selectively expanded, thereby making it possible to further stabilize the refrigeration output.

Eighth Embodiment

Figure 10:
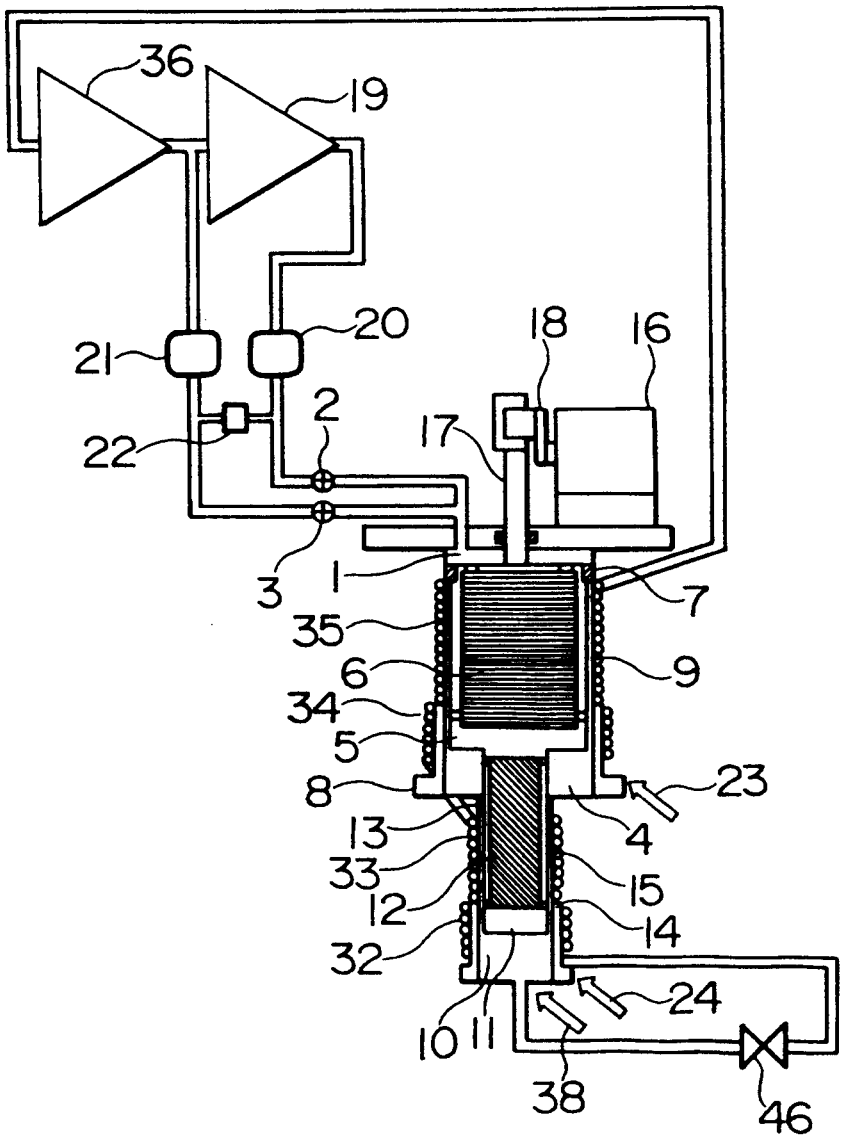
FIG. 10 is a diagram showing the construction of a cryogenic refrigerator according to an eighth embodiment of this invention.

FIG. 10 shows the construction of a cryogenic refrigerator according to the eighth embodiment of this invention. Numeral 13 indicates a throttle section, which corresponds to the seal in the prior art. In the drawing, the components which are the same as or equivalent to those of the fourth embodiment are indicated by the same reference numerals.

In this embodiment, the seal in the prior art is replaced by the simple throttle section 13 to keep the heat loss at the minimum level.

In this cryogenic refrigerator, constructed as described above, the throttle valve 46 is employed as the second expander. Part of the helium 1 present in the second-stage expansion chamber is caused to undergo JT expansion. As a result, the helium 1 can absorb thermal energy Qc 38 from the object to be cooled (not shown) through the second refrigerating stage 14 and the first heat exchanger 32. After this, the helium 1 is warmed by the second heat exchanger 33, the third heat exchange 34 which transmits a refrigeration effect to the first refrigerating stage 8, and the fourth heat exchanger 35, and the helium 1 is returned, in a room-temperature condition, to the suction side of the compressor 36 adjusted to the lower pressure level. Part of the helium 1 which is charged in or discharged from the second-stage expansion chamber 10 passes through the throttle section 13. In this process, the helium 1 effects heat exchange with the helium 1 present in the third heat exchanger 33, so that no heat loss is generated. With this construction, the seal section, which has to be made precisely, can be replaced by a simple throttle section, thereby achieving a reduction in cost, realizing a simpler structure, and providing improved reliability.

Figure 11:
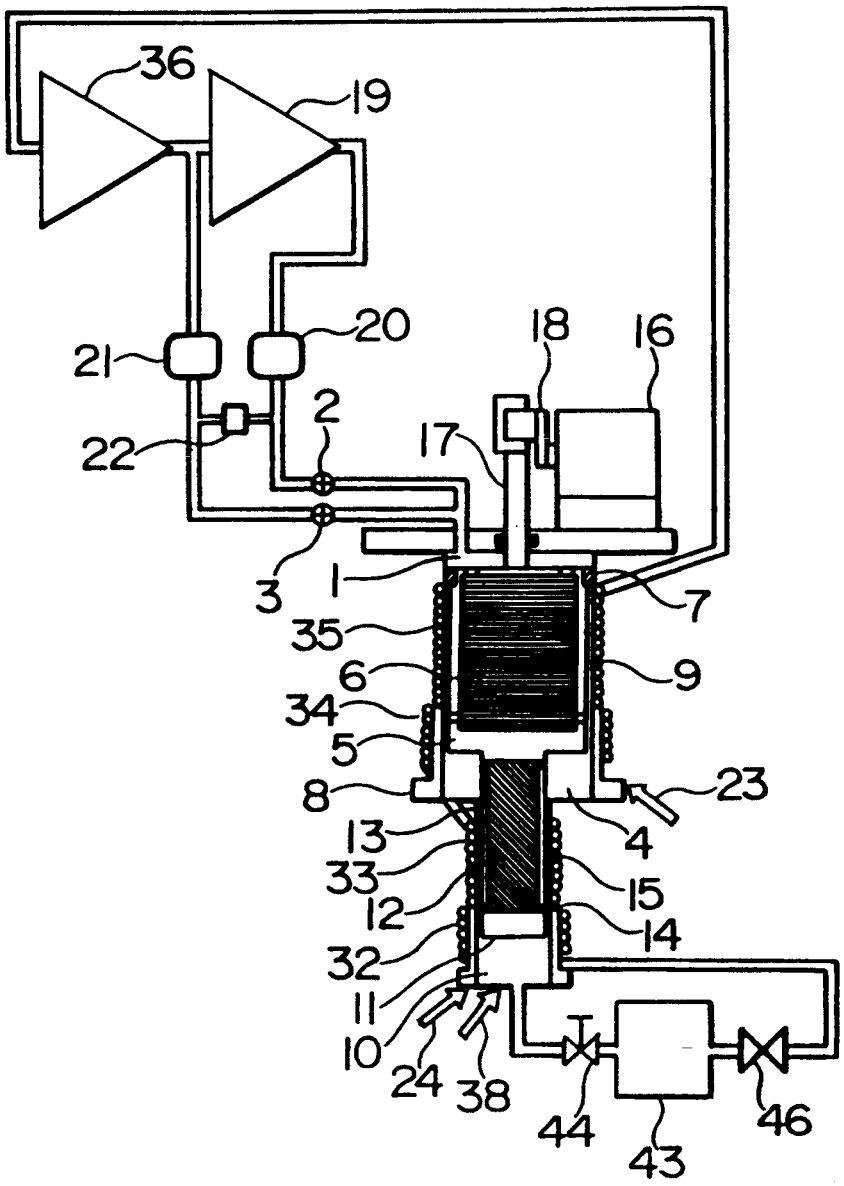
FIG. 11 is a diagram showing the construction of a cryogenic refrigerator according to a modification of the eighth embodiment of this invention.

FIG. 11 shows a modification of this embodiment in which the buffer tank 43 and the control valve 44 described with reference to the sixth embodiment are provided. This construction provides, in addition to the effects of the above embodiment, an advantage that, as in the sixth embodiment, the helium 1 at a low pressure level can be selectively expanded, thereby making it possible to further stabilize the refrigeration output.

Ninth Embodiment

Figure 12:
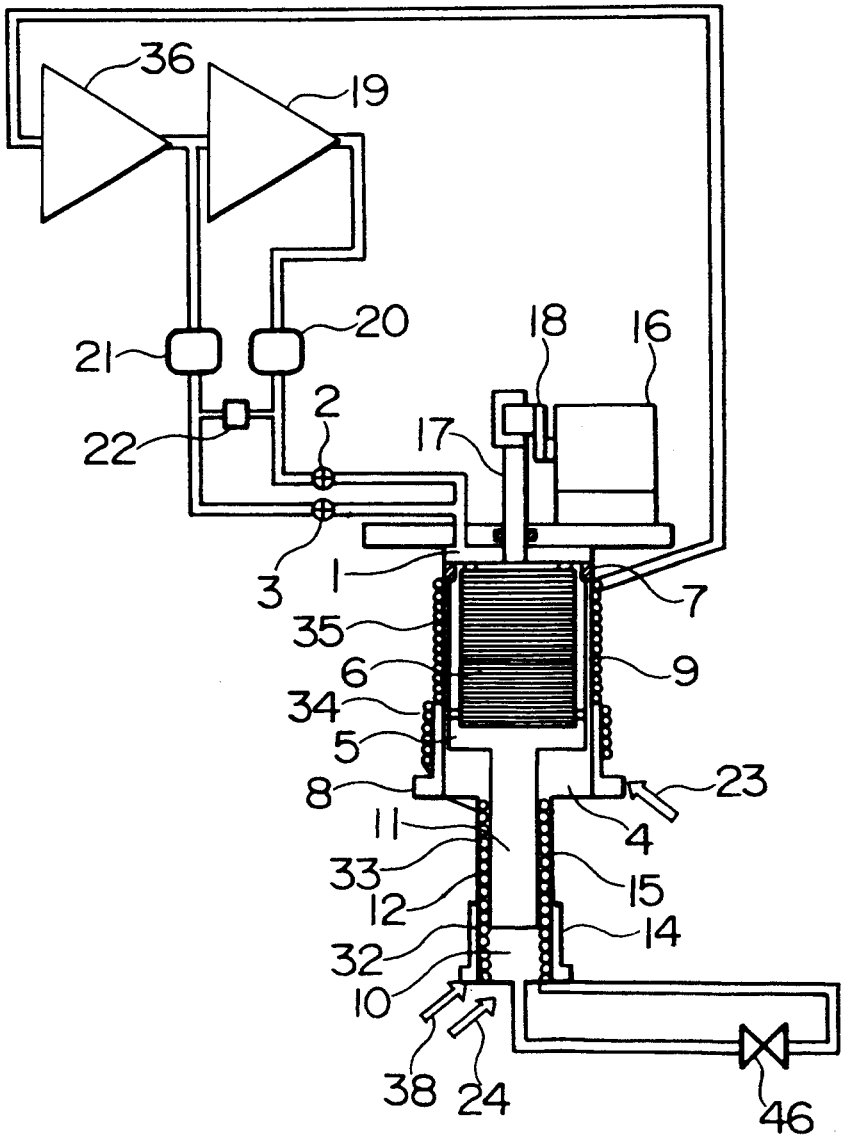
FIG. 12 is a diagram showing the construction of a cryogenic refrigerator according to a ninth embodiment of this invention.

FIG. 12 shows the construction of a cryogenic refrigerator according the ninth embodiment of this invention. In the drawing, numeral 33 indicates a flow passage adjusted to a lower pressure level of a heat exchange section provided between the second-stage cylinder 15 and the second-stage displacer 11. To provide the same adjusting function as the throttle section 13 of the eighth embodiment, the flow passage 33 is provided with an appropriate gap. Numeral 12 indicates a flow passage adjusted to a higher pressure level, which is formed at a position inside the second-stage cylinder 15 and outside the flow passage 33 at the lower pressure level, forming a heat exchange section between the flow passage 33 at the lower pressure level and the flow passage 12 at the higher pressure level. Numeral 32 indicates a first heat exchanger. The other components which are the same as or equivalent to those of the seventh embodiment are indicated by the same reference numerals.

This cryogenic refrigerator, constructed as described above, employs the throttle valve 46 as the second expander. In this embodiment, part of the helium 1 present in the second-stage expansion chamber undergoes JT expansion by means of the throttle valve 46. As a result, it is possible for the helium 1 to absorb thermal energy Qc 38 from the object to be cooled (not shown) through the second refrigerating stage 14 and the first heat exchanger 32. After this, the helium 1 is warmed by the second heat exchanger 33, the third heat exchanger 34 which transmits a refrigeration effect to the first refrigerating stage 8, and the fourth heat exchanger 35, and the helium 1 is returned, in a room-temperature state, to the suction side of the compressor 36 adjusted to the lower pressure level.

The helium 1 which is charged in or discharged from the second-stage expansion space 10 passes through the flow passage 12 at the higher pressure level of the heat exchange section formed outside the flow passage 33 at the lower pressure level provided between the second-stage cylinder 15 and the second-stage displacer 11. In this process, this helium effects heat exchange with the helium 1 present in the flow passage 33 at the lower pressure level. When at a lower pressure, the helium 1 has a large specific heat and functions as a good accumulating material.

As in the seventh embodiment, the helium 1 present in the flow passage 33 at the lower pressure level is flowing, so that a satisfactory heat exchange is possible by effectively utilizing the specific heat of the helium. Further, unlike the seventh embodiment, this construction allows the stage 41 to be omitted; further, the throttle section 13 in the eighth embodiment can also be omitted, thereby realizing a simpler structure.

Figure 13:
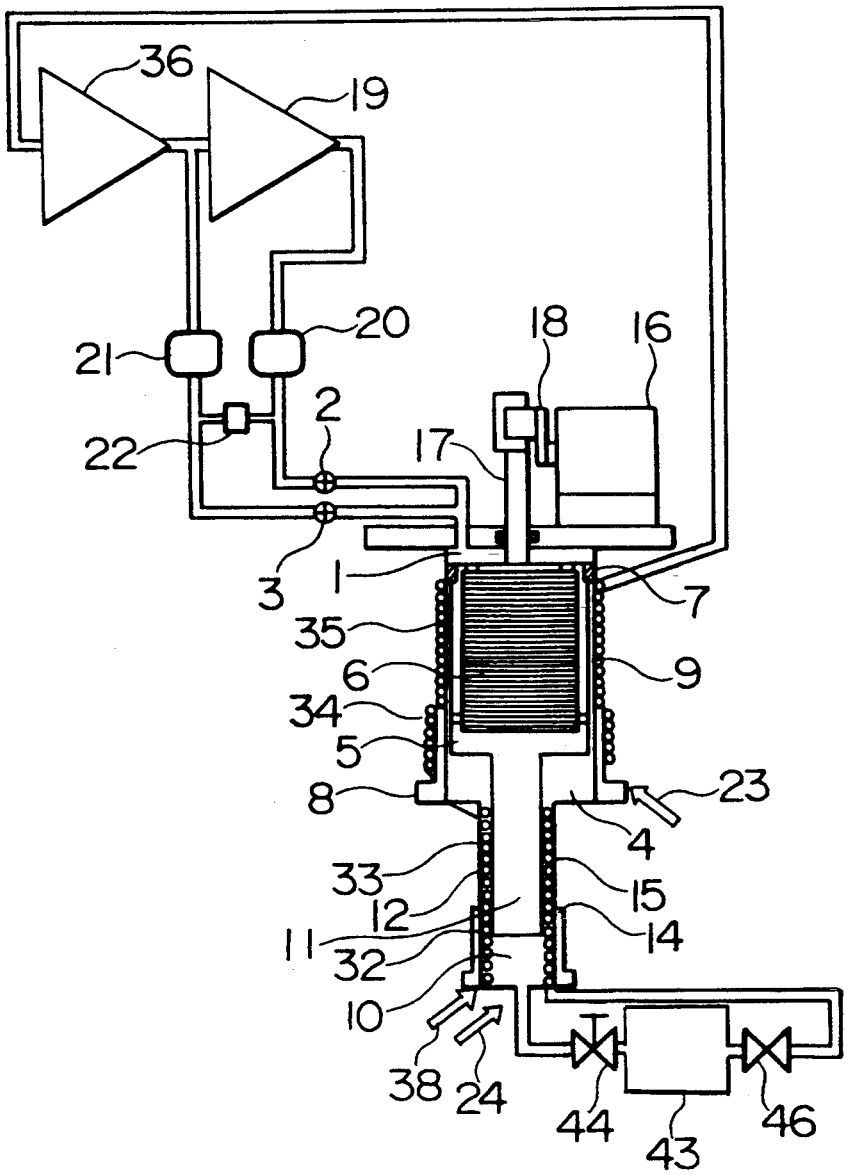
FIG. 13 is a diagram showing the construction of a cryogenic refrigerator according to a modification of the ninth embodiment of this invention.

FIG. 13 shows a modification of the ninth embodiment in which the buffer tank 43 and the control valve 44 of the sixth embodiment are provided. This construction provides, in addition to the effects of the above embodiment, an advantage that, as in the sixth embodiment, the helium 1 at a low pressure level can be selectively expanded, thereby making it possible to further stabilize the refrigeration output.

Tenth Embodiment

Figure 14:
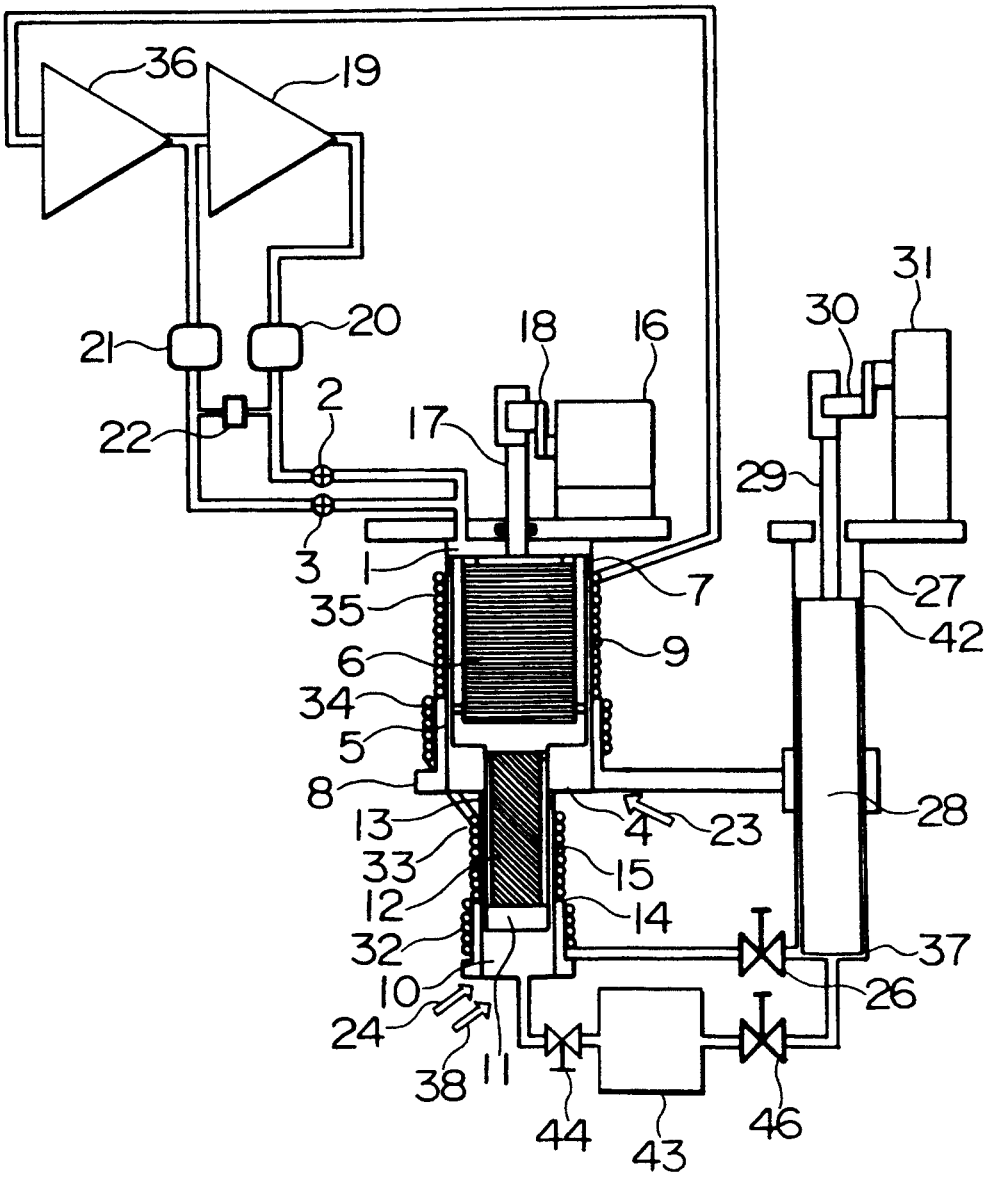
FIG. 14 is a diagram showing the construction of a cryogenic refrigerator according to a tenth embodiment of this invention.

FIG. 14 shows the construction of a cryogenic refrigerator according to the tenth embodiment of this invention. In the drawing, numeral 43 indicates a buffer tank; numeral 44 indicates a control valve; and numeral 45 indicates a thermal anchor. The other components which are the same as or equivalent to those of the seventh embodiment are indicated by the same reference numerals.

In this cryogenic refrigerator, constructed as described above, the thermal anchor 45 serves to mitigate the heat loss due to thermal conduction, etc. Further, by virtue of the buffer tank 43 and the control valve 44, it is possible to selectively expand the helium 1 at a low pressure level, as in the case of the sixth embodiment. In addition, the fluctuations in the suction pressure of the sub-expansion space 37 can be mitigated, thereby making it possible to further enhance the refrigerating efficiency of the refrigerator and stabilize the refrigeration output thereof.

Eleventh Embodiment

Figure 15:
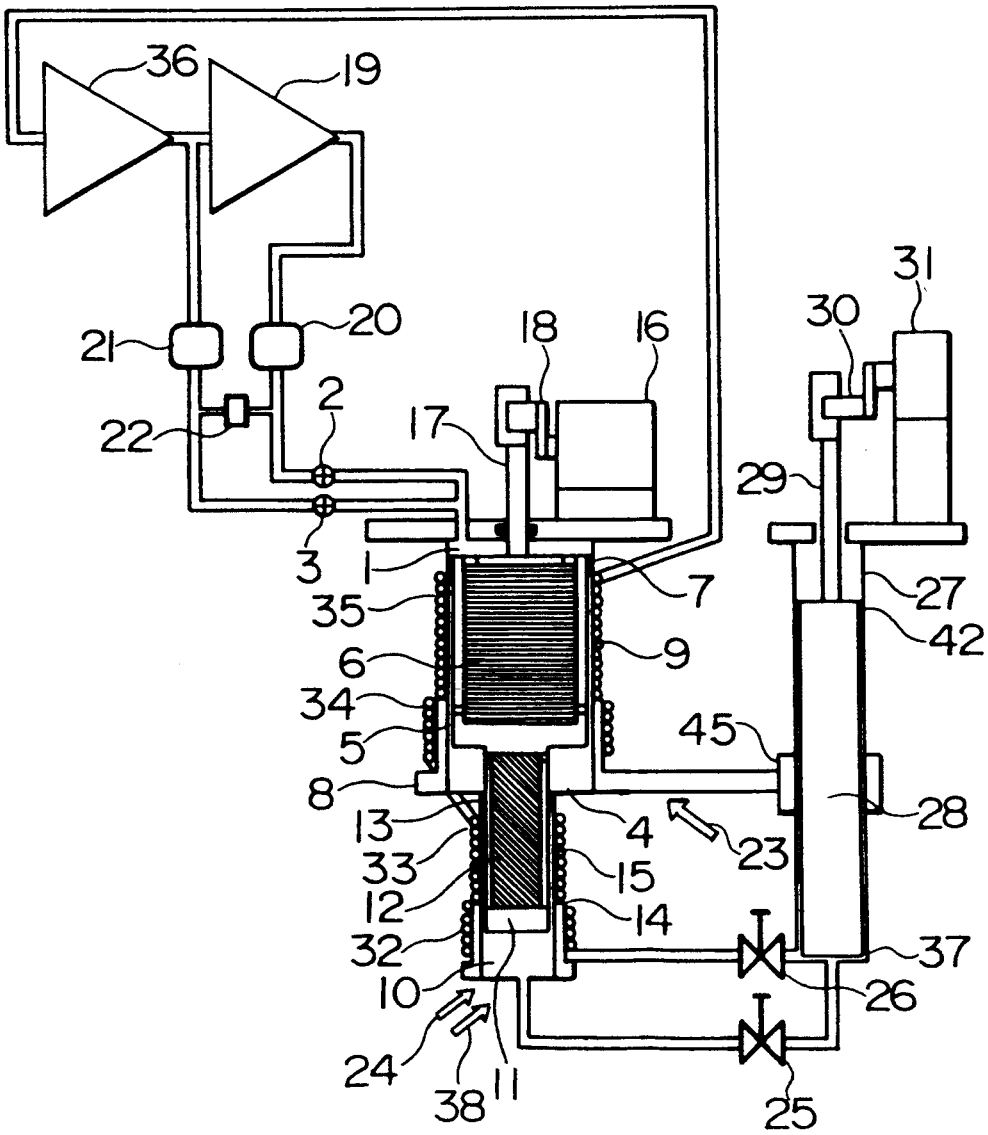
FIG. 15 is a diagram showing the construction of a cryogenic refrigerator according to an eleventh embodiment of this invention.

FIG. 15 shows the construction of a cryogenic refrigerator according to the eleventh embodiment of this invention. Numeral 13 indicates a throttle section, and numeral 45 indicates a thermal anchor for mitigating the thermal loss due to thermal conduction, etc. In the drawing, the components which are the same as or equivalent to those of the first embodiment are indicated by the same reference numerals.

With this cryogenic refrigerator, constructed as described above, the same effects as those of the eighth embodiment can be achieved. Part of the helium 1 which is sucked in or discharged from the second-stage expansion chamber 10 passes through the throttle section 13 to effect heat exchange with the helium 1 present in the third heat exchanger 33, so that no heat loss is generated. With this construction, the seal section, which has to be made precisely, can be replaced by a simple throttle section, thereby achieving a reduction in cost, realizing a simpler structure, and providing improved reliability.

Figure 16:
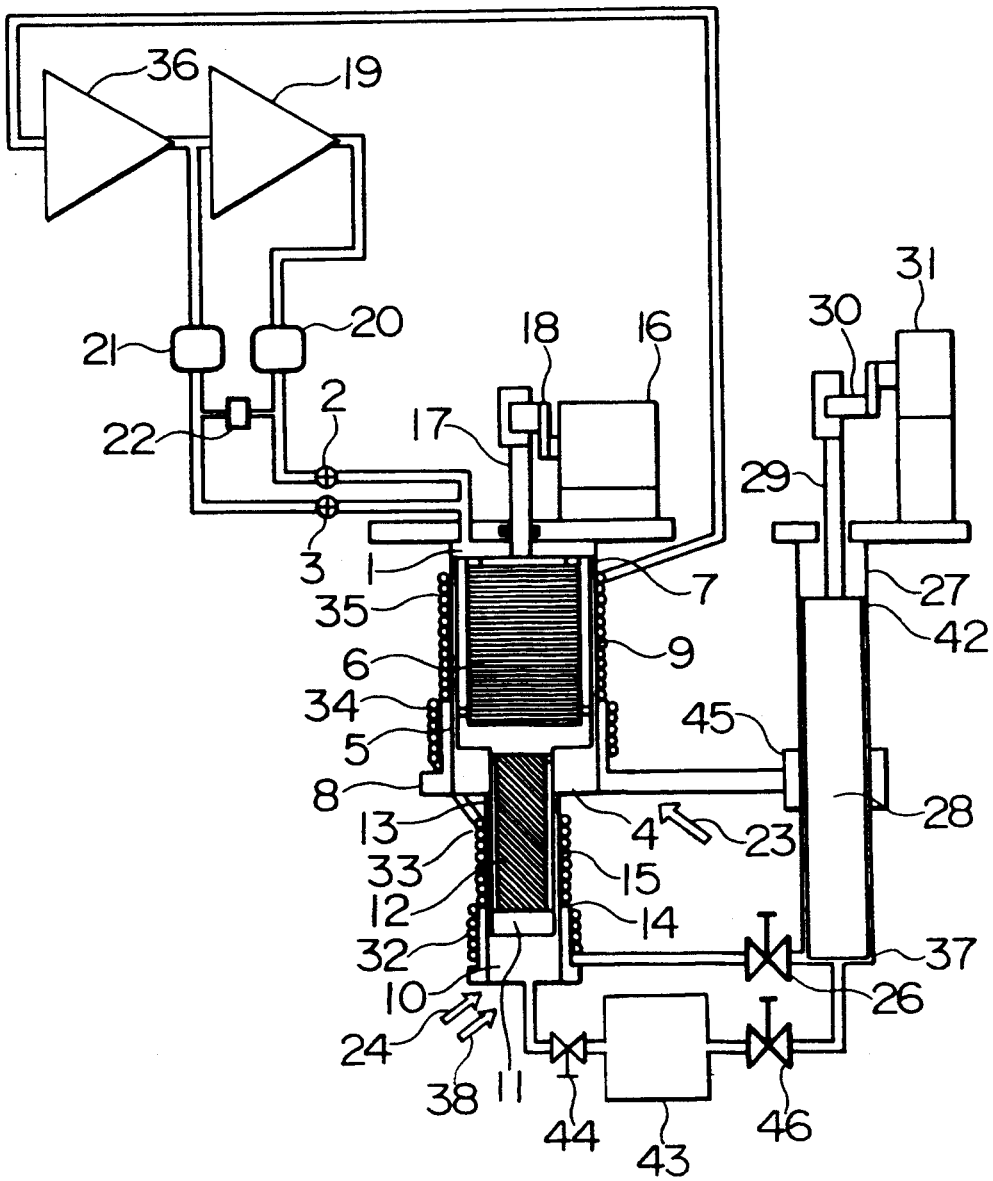
FIG. 16 is a diagram showing the construction of a cryogenic refrigerator according to a modification of the eleventh embodiment of this invention.

FIG. 16 shows a modification of this embodiment in which the buffer tank 43 and the control valve 44 are provided. This construction provides, in addition to the effects of the above embodiment, an advantage that the helium 1 at a low pressure level can be selectively expanded. Further, the fluctuations in the suction pressure of the sub-expansion chamber 37 can be mitigated, thereby making it possible to further enhance the refrigerating efficiency of the refrigerator and stabilize the refrigeration output thereof.

Twelfth Embodiment

Figure 17:
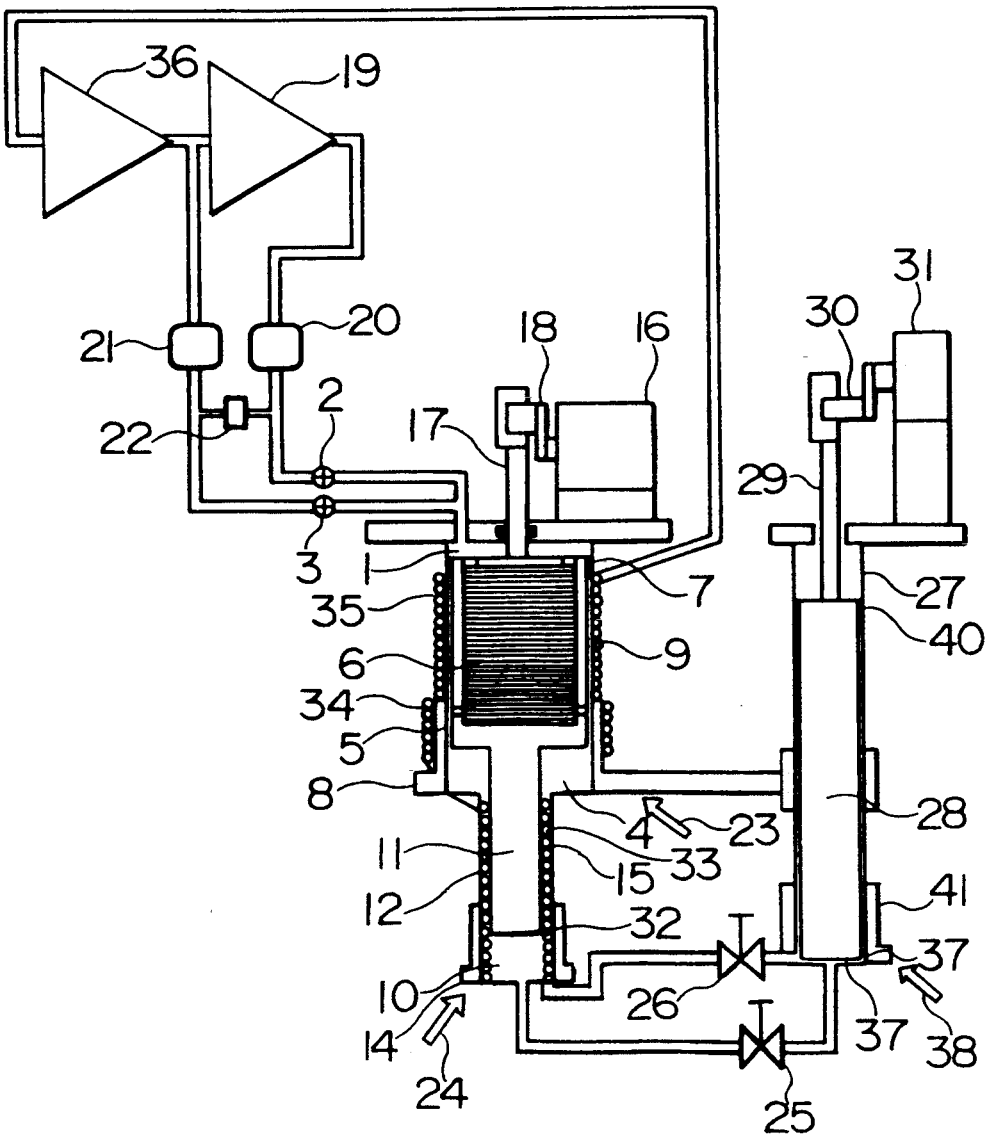
FIG. 17 is a diagram showing the construction of a cryogenic refrigerator according to a twelfth embodiment of this invention.

FIG. 17 shows the construction of a cryogenic refrigerator according to the twelfth embodiment of this invention. In the drawing, numeral 12 indicates the flow passage at the higher pressure level of the heat exchange section; numeral 33 indicates the flow passage at the lower pressure level of the heat exchange section; numeral 32 indicates the first heat exchanger; and numeral 45 indicates the thermal anchor, which serves to mitigate the heat loss due to thermal conduction, etc. The other components which are the same as or equivalent to those of the first embodiment are indicated by the same reference numerals.

This cryogenic refrigerator, constructed as described above, includes, as the second expander, the sub-expansion space 37, which constitutes the displacement-type expander body, the sub-inlet valve 25, and the sub-outlet valve 26, as in the first embodiment. Further, the piston 28, the rod 29, the crank 30 and the power absorber 31 constitute a power absorption mechanism.

As in the first embodiment, in this cryogenic refrigerator, constructed as described above, the sub-inlet valve 25 is opened and the sub-outlet valve 26 is closed to introduce a fixed amount of the helium 1 present in the second-stage expansion space 10 into the sub-expansion space 37 through the sub-inlet valve 25. This helium 1 pushes up the piston 28 as it expands, for example, from 6 bar to 1 bar, thereby exerting a work on the power absorber 31 through the piston 28, the rod 29 and the crank 30. At the same time, thermal energy Qc 38 is absorbed from the object to be cooled (not shown) through the stage 41, thereby effecting refrigeration. After this, the sub-inlet valve 25 is closed and the sub-outlet valve 26 is opened, whereby the helium 1 is discharged through the sub-outlet valve 26. Then, the helium 1 is warmed by the flow passage 33 at the lower pressure level of the heat exchange section, the third heat exchanger 34 which transmits a refrigeration effect to the first refrigerating stage 8, and the fourth heat exchanger 35, and the helium is returned, in a room temperature condition, to the suction side of the compressor 36 adjusted to the lower pressure level.

The helium 1 which is charged in or discharged from the second-stage expansion space 10 passes through the flow passage 12 at the higher pressure level of the heat exchange section formed outside the flow passage 33 at the lower pressure level provided between the second-stage cylinder 15 and the second-stage displacer 11. In this process, this helium effects heat exchange with the helium 1 present in the flow passage 33 at the lower pressure level. When at a lower pressure, the helium 1 has a large specific heat and functions as a good accumulating material.

With this embodiment, the same effect as that of the ninth embodiment can be achieved. Since the helium 1 present in the flow passage 33 adjusted to the lower pressure level functions as the accumulating material, there is no need to use an expensive accumulating material.

Figure 18:
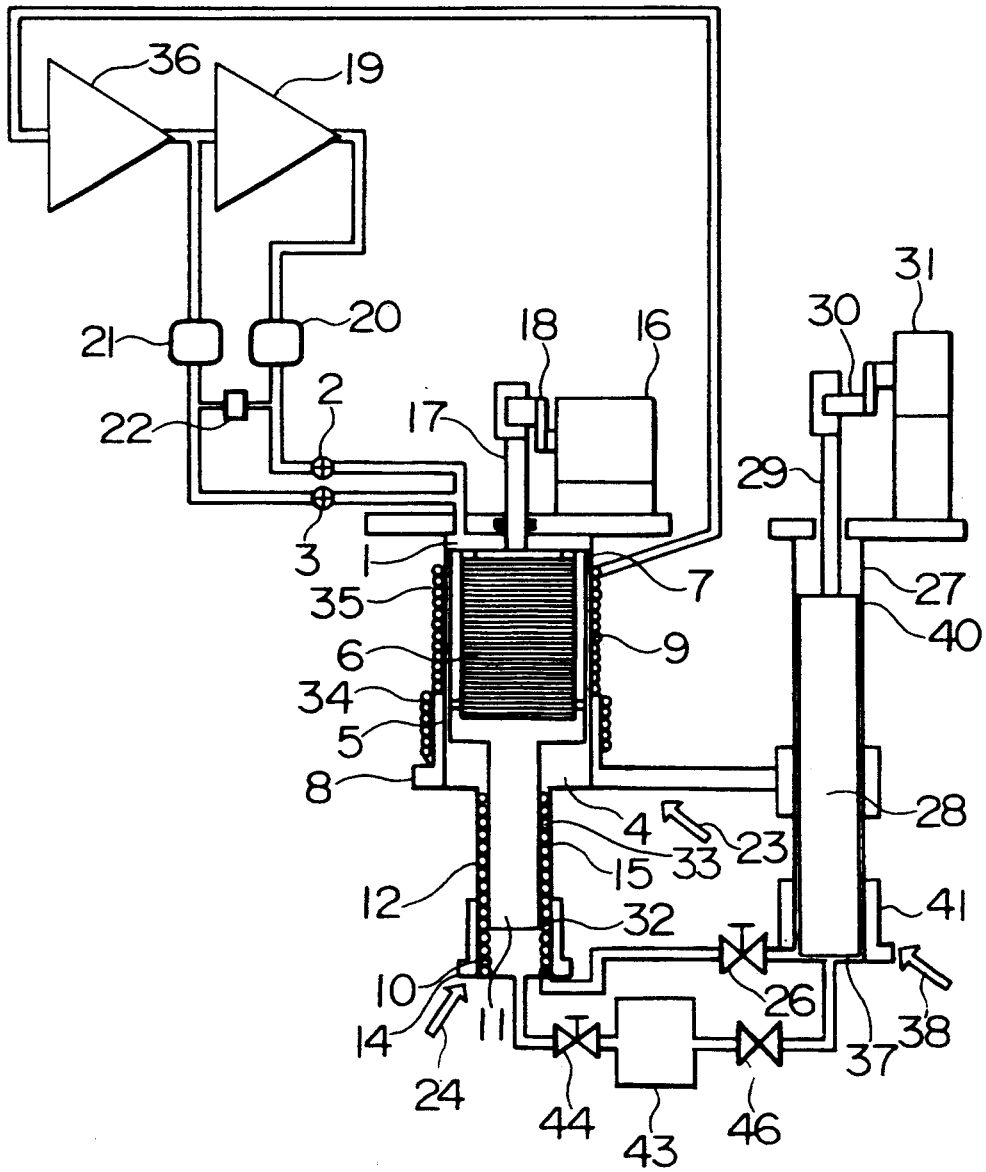
FIG. 18 is a diagram showing the construction of a cryogenic refrigerator according to a modification of the twelfth embodiment of this invention.

FIG. 18 shows a modification of this embodiment in which the buffer tank 43 and the control valve 44 described with reference to the tenth embodiment are provided. In addition to the above effects, this construction makes it possible to selectively expand the helium 1 at a low pressure level, as in the tenth embodiment. Further, since the fluctuation in the suction pressure of the sub-expansion chamber 37 can be mitigated, it is possible to further enhance the refrigerating efficiency of the refrigerator and stabilize the refrigeration output thereof.

Thirteenth Embodiment

Figure 19:
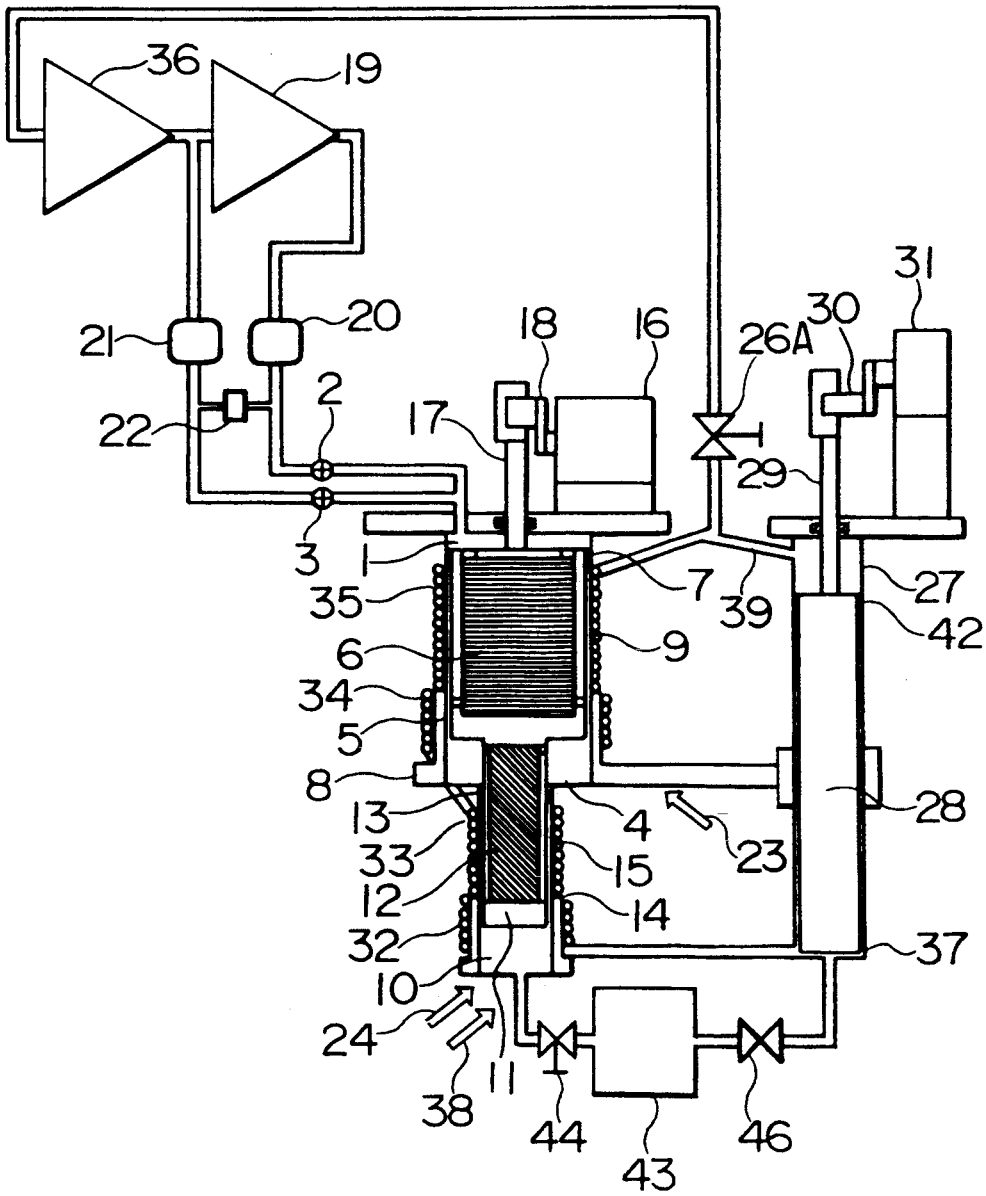
FIG. 19 is a diagram showing the construction of a cryogenic refrigerator according to a thirteenth embodiment of this invention.

FIG. 19 shows the construction of a cryogenic refrigerator according to the thirteenth embodiment of this invention. In the drawing, numeral 43 indicates a buffer tank; numeral 44 indicates a control valve; and numeral 45 indicates a thermal anchor. The thermal anchor 45 serves to mitigate the heat loss due to thermal conduction, etc. The other components which are the same as or equivalent to those of the second embodiment are indicated by the same reference numerals.

This cryogenic refrigerator, constructed as described above, provides, in addition to the effects of the construction of the second embodiment, an advantage that the thermal anchor 45 mitigates the heat loss due to thermal conduction, etc. Further, by virtue of the buffer tank 43 and the control valve 44, it is possible to selectively expand the helium 1 at a low pressure level, as in the case of the sixth embodiment. In addition, the fluctuations in the suction pressure of the sub-expansion space 37 can be mitigated, thereby making it possible to further enhance the refrigerating efficiency of the refrigerator and stabilize the refrigeration output thereof.

Fourteenth Embodiment

Figure 20:
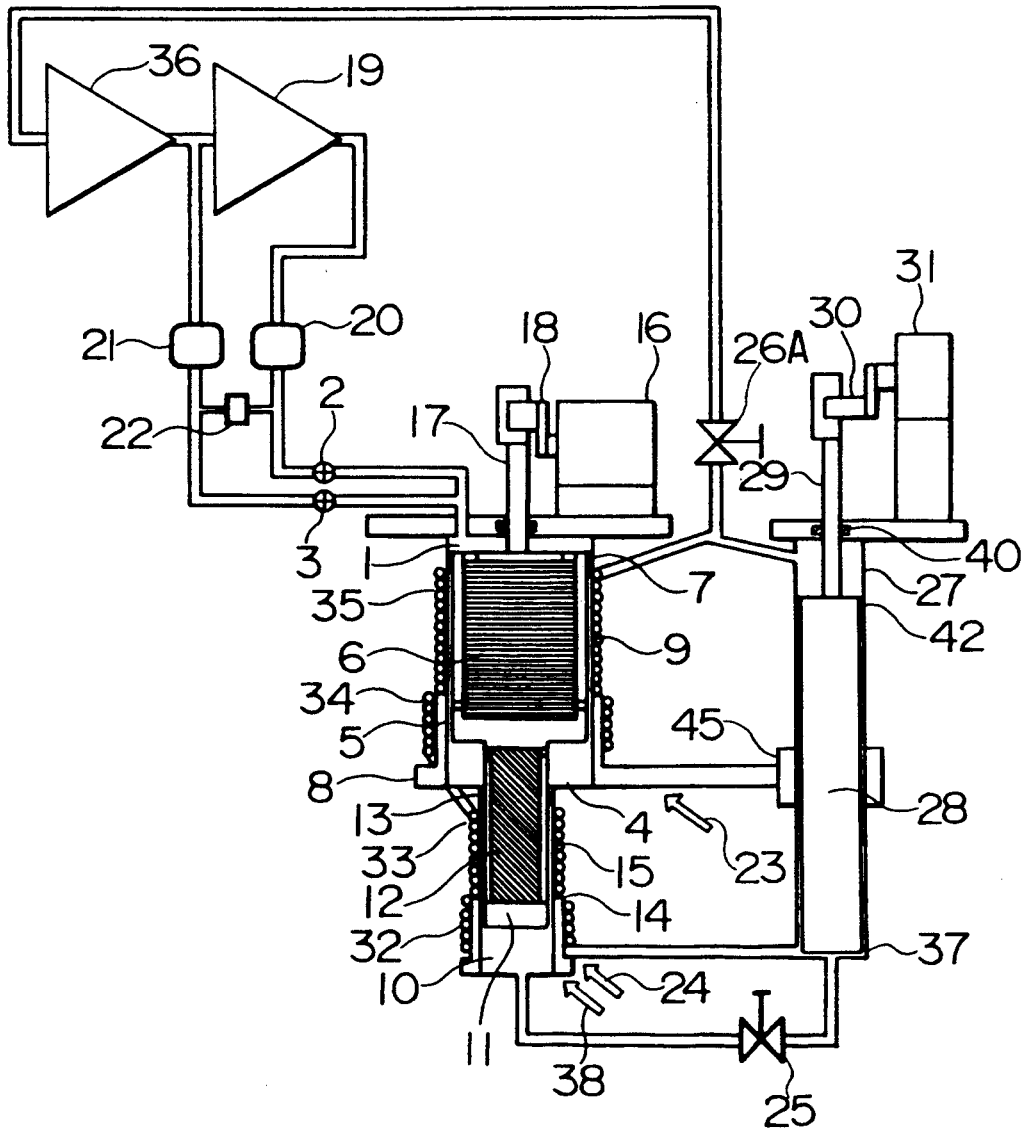
FIG. 20 is a diagram showing the construction of a cryogenic refrigerator according to a fourteenth embodiment of this invention.

FIG. 20 shows the construction of a cryogenic refrigerator according to the fourteenth embodiment of this invention. In the drawing, numeral 13 indicates a throttle valve; and numeral 45 indicates a thermal anchor for mitigating the heat loss due to thermal conduction, etc. The other components which are the same as or equivalent to those of the second embodiment are indicated by the same reference numerals.

The cryogenic refrigerator, constructed as described above, operates in the same manner as the refrigerator of the second embodiment. Further, part of the helium 1 which is sucked in or discharged from the second-stage expansion space 10 passes through the throttle section 13 to effect heat exchange with the helium 1 present in the third heat exchanger 33, so that no heat loss is generated. With this construction, the seal section which has to be made precisely can be replaced by a simple throttle section, thereby realizing a reduction in price, simplifying the structure of the refrigerator and improving the reliability thereof.

Figure 21:
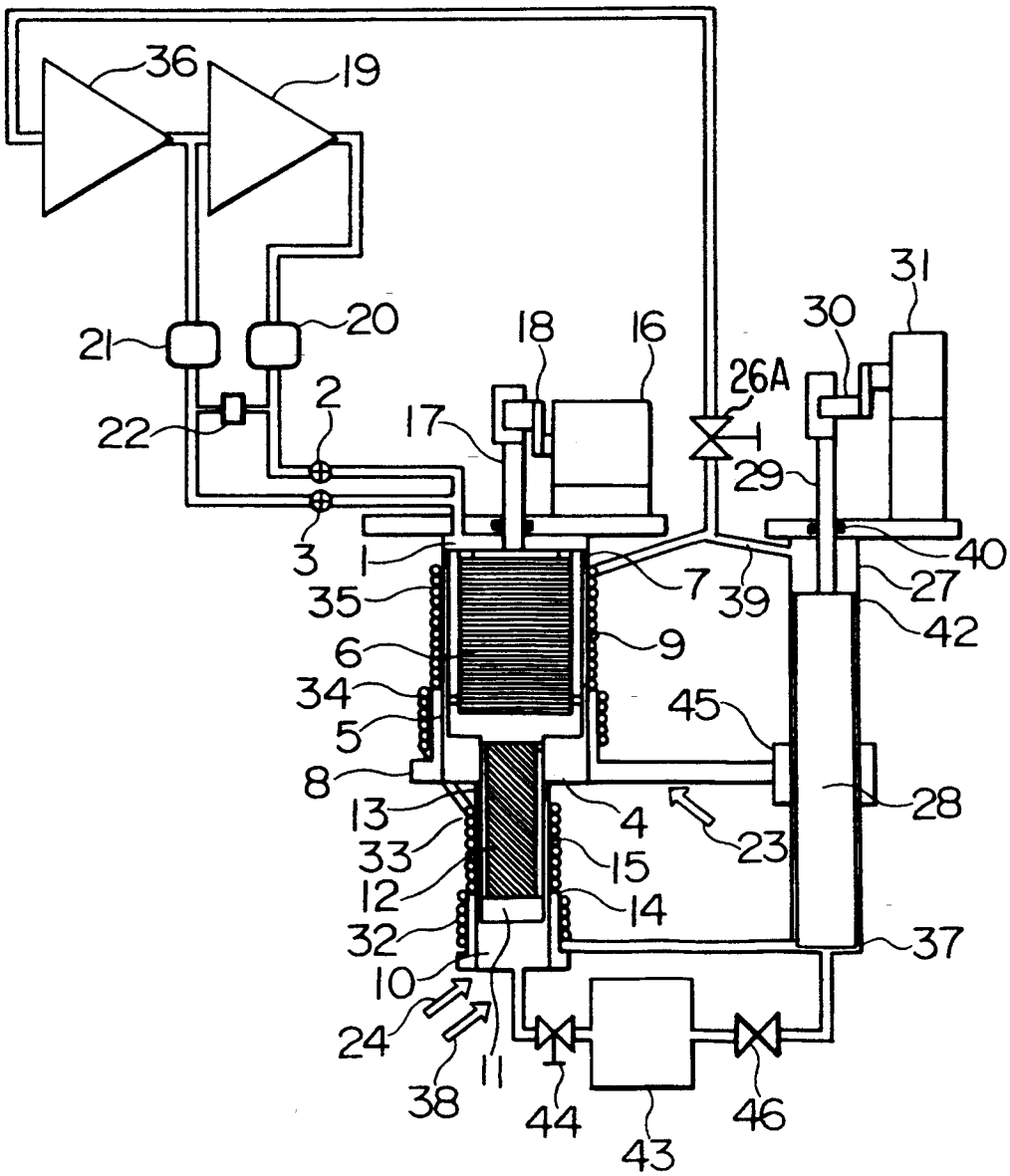
FIG. 21 is a diagram showing the construction of a cryogenic refrigerator according to a modification of the fourteenth embodiment of this invention.

FIG. 21 shows a modification of this embodiment in which the buffer tank 43 and the control valve 44 are provided. Thus, in addition to the above effects, this construction makes it possible to selectively expand the helium 1 at a low pressure level. Further, since the fluctuation in the suction pressure of the sub-expansion space 37 can be mitigated, it is possible to further enhance the refrigerating efficiency of the refrigerator and stabilize the refrigeration output thereof.

Fifteenth Embodiment

Figure 22:
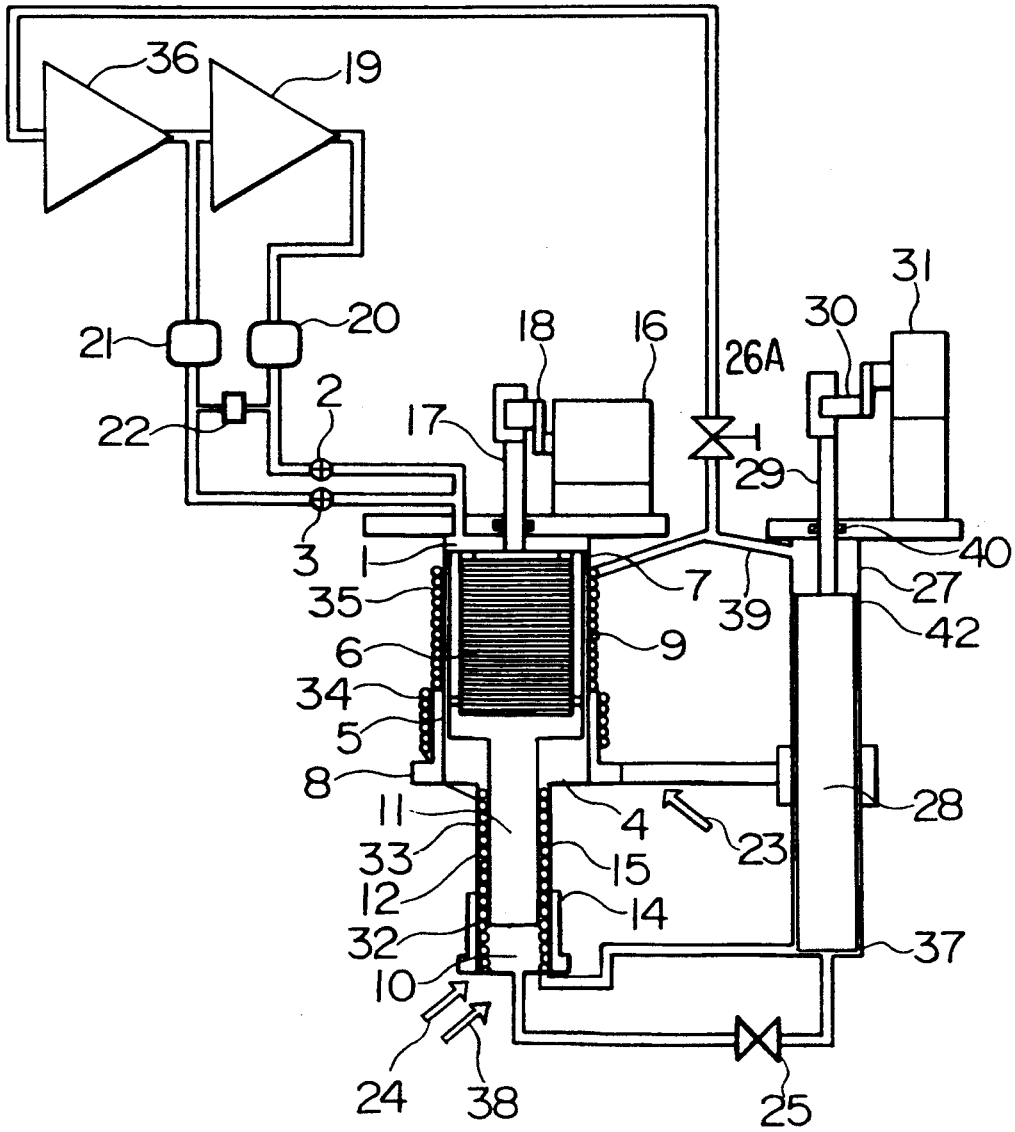
FIG. 22 is a diagram showing the construction of a cryogenic refrigerator according to a fifteenth embodiment of this invention.

FIG. 22 shows the construction of a cryogenic refrigerator according to the fifteenth embodiment of this invention. In the drawing, numeral 12 indicates the flow passage at the higher pressure level of the heat exchange section; numeral 33 indicates the flow passage at the lower pressure level of the heat exchange section; numeral 32 indicates the first heat exchanger; and numeral 45 indicates the thermal anchor, which serves to mitigate the heat loss due to thermal conduction, etc. The other components which are the same as or equivalent to those of the second embodiment are indicated by the same reference numerals.

This cryogenic refrigerator, constructed as described above, operates in the same manner as the second embodiment. Since the helium 1 present in the flow passage 33 at the lower pressure level functions as the accumulating material, there is no need to use an expensive accumulating material.

Figure 23:
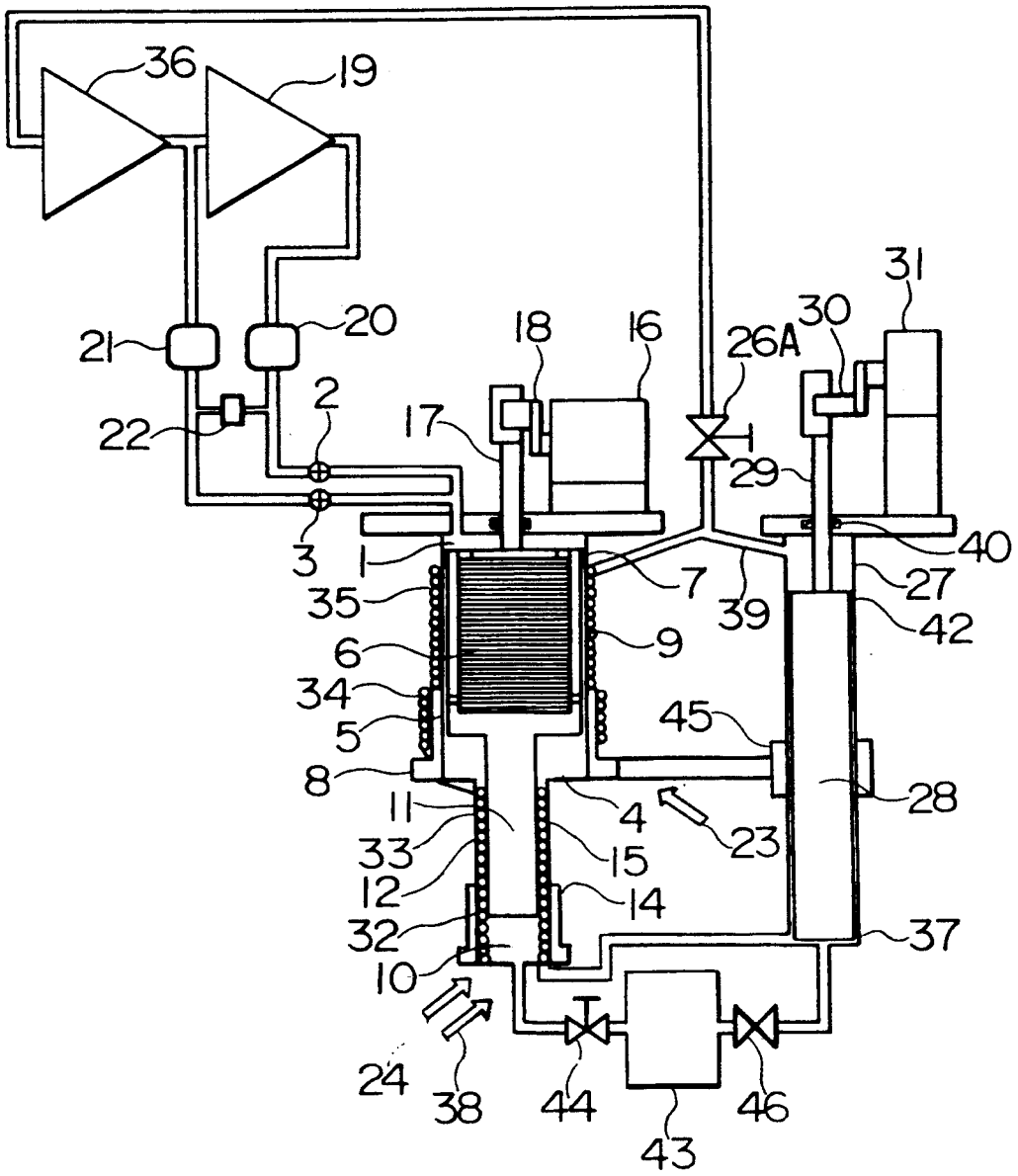
FIG. 23 is a diagram showing the construction of a cryogenic refrigerator according to a modification of the fifteenth embodiment of this invention.

FIG. 23 shows a modification of this embodiment in which the buffer tank 43 and the control valve 44 are provided. Thus, in addition to the above effects, this construction makes it possible to selectively expand the helium 1 at a low pressure level. Further, since the fluctuation in the suction pressure of the sub-expansion space 37 can be mitigated, it is possible to further enhance the refrigerating efficiency of the refrigerator and stabilize the refrigeration output thereof.

Sixteenth Embodiment

Figure 24:
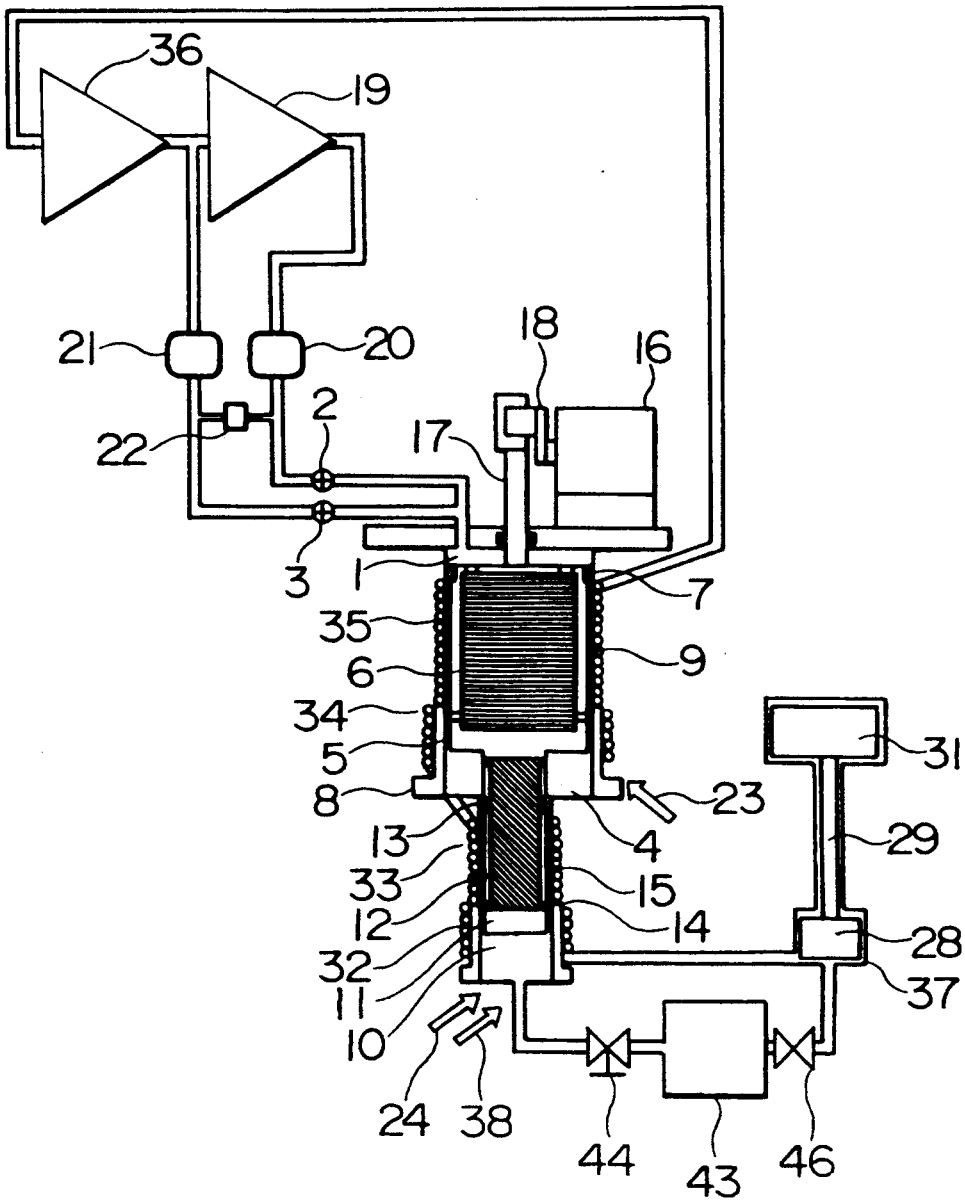
FIG. 24 is a diagram showing the construction of a cryogenic refrigerator according to a sixteenth embodiment of this invention.
Figure 25:
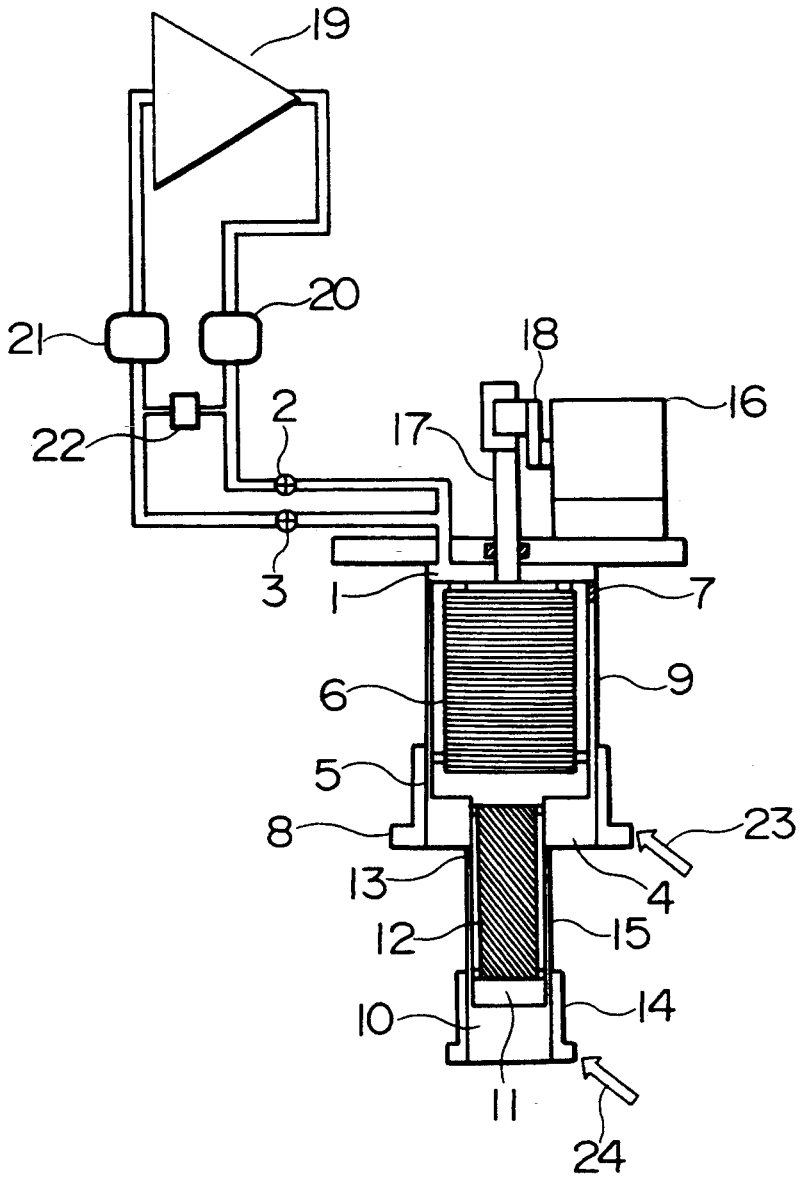
FIG. 25 PRIOR ART
FIG. 25 is a diagram showing the construction of a conventional cryogenic refrigerator.

FIG. 24 shows the construction of a cryogenic refrigerator according to the sixteenth embodiment of this invention. In the drawing, numeral 43 indicates the buffer tank; and numeral 44 indicates the control valve. The other components which are the same as or equivalent to those of the third embodiment are indicated by the same reference numerals.

This cryogenic refrigerator, constructed as described above, operates in the same manner as that of the third embodiment. Further, by virtue of the buffer tank 43 and the control valve 44, it is possible to selectively expand the helium 1 at a low pressure level. In addition, the fluctuations in the suction pressure of the sub-expansion space 37 can be mitigated, thereby making it possible to further enhance the refrigerating efficiency of the refrigerator and stabilize the refrigeration output thereof.

While the above embodiments have been described with reference to a Gifford-Macmahon-type refrigerator, the present invention is also applicable to other types of refrigerators, for example, a Stirling refrigerator, Vuilleumiex refrigerator, Solvay refrigerator, or pulse tube refrigerator. Further, although the above embodiments have been described with reference to a two-stage-type refrigerator, the present invention is obviously also applicable to a refrigerator having one stage, or three stages or more.

While the above embodiments have been described with reference to the case in which the second expander is connected to the final stage expansion space, the present invention is also applicable to the case in which the second expander is connected to the other stage expansion space.

Further, although in the above embodiments the compressor at the lower pressure level and that at the higher pressure level are are arranged in series, it is also possible to arrange them in parallel, or change the compressors to multi-stage-type ones.

In addition, while the above embodiments employed helium as the working fluid, the present invention is also applicable to a refrigerator using helium 3, hydrogen, etc. as the working fluid.

Further, the working pressures of 6 bar and 20 bar in the above embodiments should not be construed restrictively. Other working pressures may also be employed.

As described above, according to the first aspect of the present invention, there are provided: a first compressor; a first expander having at least one accumulator using an accumulating material comprising a rare earth alloy or compound which has a large specific weight at 10 K. or below or an accumulating material comprising of helium; a second expander which effects further expansion of a working fluid introduced thereto from an expansion space of the first expander; and a second compressor which compresses the working fluid, whereby a cryogenic refrigerator which has an enhanced refrigerating efficiency can be obtained.

According to the second aspect of the present invention, the second expander includes a displacement-type expander body, an inlet valve, a an outlet valve, and a power absorption mechanism, whereby a cryogenic refrigerator can be obtained which, in addition to the effect of the first aspect of this invention, provides a further enhanced refrigerating efficiency.

According to the third aspect of the present invention, the second expander includes a Simon-expansion-type expander body, an inlet valve, and a an outlet valve, whereby a cryogenic refrigerator can be obtained which, in addition to the effect of the first aspect of this invention, provides a further enhanced refrigerating efficiency, facilitates power absorption, and has a simplified structure.

According to the fourth aspect of the present invention, the second expander comprises of a throttle section, whereby a cryogenic refrigerator can be obtained which, in addition to the effect of the first aspect of this invention, provides a further enhanced refrigerating efficiency, has a remarkably simplified structure, and is inexpensive.

According to the fifth aspect of the present invention, a control valve is provided on the outlet side of an expansion space of the first expander, and a buffer tank for temporarily storing the working fluid is provided between this control valve and the second expander, whereby a cryogenic refrigerator can be obtained in which, in addition to the effect of the first aspect of this invention, the refrigeration output of the second expander is stable and which provides a further enhanced refrigerating efficiency.

According to the sixth aspect of the present invention, the cryogenic refrigerator has at least one heat exchanger which performs heat exchange between the working fluid returning from the second expander and the working fluid by the first expander, whereby a cryogenic refrigerator can be obtained which, in addition to the effect of the first aspect of this invention, has the advantage of being inexpensive.

Further, according to the seventh aspect of the present invention, the cryogenic refrigerator further comprises at least one throttle section capable of generating a controlled leakage, and at least one heat exchange section for effecting heat exchange between the working fluid passing through this throttle section and the working fluid returning from the second expander whereby a cryogenic refrigerator can be obtained which, in addition to the effect of the first aspect of this invention, has a long service life and a high level of refrigerating performance.

What is claimed is:

1. A cryogenic refrigerator comprising: a first compressor; a first expander having at least one accumulator using an accumulating material comprising a rare earth alloy or compound which has a large specific heat at 10 K. or below or an accumulating material comprising helium; a second expander which effects further expansion of a working fluid introduced thereto from an expansion space of the first expander; and a second compressor which comprises the working fluid;

wherein the second expander includes a displacement-type expander body, an inlet valve, an outlet valve, and a power absorption mechanism.

2. A cryogenic refrigerator according to claim 1, wherein a control valve is provided on an outlet side of an expansion space of the first expander, and a buffer tank for temporarily storing the working fluid is provided between said control valve and the second expander.

3. A cryogenic refrigerator according to claim 1, further comprising at least one heat exchanger which performs heat exchange between the working fluid returning from the second expander and the working fluid in the first expander.

4. A cryogenic refrigerator according to claim 1, further comprising at least one throttle section capable of generating a controlled leakage, and at least one heat exchange section for effecting heat exchange between the working fluid passing through said throttle section and the working fluid returning from the second expander.

* * * * *